US011242719B2

(12) United States Patent
Montoya et al.

(10) Patent No.: US 11,242,719 B2
(45) Date of Patent: Feb. 8, 2022

(54) SUBTERRANEAN CORING ASSEMBLIES

(71) Applicant: CHEVRON U.S.A. INC., San Ramon, CA (US)

(72) Inventors: James Daniel Montoya, Santa Fe, NM (US); Byron Kurt Deshotels, Breaux Bridge, LA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 45 days.

(21) Appl. No.: 16/309,822

(22) PCT Filed: Nov. 27, 2018

(86) PCT No.: PCT/US2018/062635
§ 371 (c)(1),
(2) Date: Dec. 13, 2018

(87) PCT Pub. No.: WO2019/104332
PCT Pub. Date: May 31, 2019

(65) Prior Publication Data

US 2021/0222516 A1 Jul. 22, 2021

Related U.S. Application Data

(63) Continuation-in-part of application No. 15/823,002, filed on Nov. 27, 2017, now Pat. No. 10,577,879.

(51) Int. Cl.
*E21B 21/10* (2006.01)
*E21B 34/10* (2006.01)
(Continued)

(52) U.S. Cl.
CPC ..... *E21B 21/103* (2013.01); *E21B 21/10* (2013.01); *E21B 25/00* (2013.01); *E21B 25/10* (2013.01); *E21B 34/10* (2013.01)

(58) Field of Classification Search
CPC ..... E21B 34/10; E21B 25/00; E21B 21/103; E21B 34/08; E21B 21/10; E21B 25/10
See application file for complete search history.

(56) References Cited

U.S. PATENT DOCUMENTS 3,385,370 A * 5/1968 Knox ..... E21B 34/063 166/317
4,625,762 A * 12/1986 Hassanzadeh ..... E21B 21/10 137/624.27

(Continued)

FOREIGN PATENT DOCUMENTS

WO WO 1986/002124 4/1986
WO WO 2014/031120 2/2014

OTHER PUBLICATIONS

International Search Report issued in PCT/US2018/062635, dated Feb. 21, 2019, 2 pages.

*Primary Examiner* — Nicole Coy
(74) *Attorney, Agent, or Firm* — King & Spalding LLP

(57) ABSTRACT

A subterranean coring assembly can include a body having at least one wall that forms a cavity, wherein the cavity has a top end and a bottom end. The subterranean coring assembly can also include a first flow regulating device movably disposed within the cavity, where the first flow regulating device is configured to move from a first default position to a first position within the cavity based on first flow characteristics of fluid that flows into the top end of the cavity toward the bottom end of the cavity.

18 Claims, 16 Drawing Sheets

(51) Int. Cl.
*E21B 25/00* (2006.01)
*E21B 25/10* (2006.01)

(56) References Cited

U.S. PATENT DOCUMENTS

| | | | | |
|---|---|---|---|---|
| 4,683,955 | A * | 8/1987 | Stepp | E21B 21/10 166/326 |
| 5,799,742 | A | 9/1998 | Soinski et al. | |
| 5,890,540 | A | 4/1999 | Pia et al. | |
| 6,622,795 | B2 * | 9/2003 | Hebert | E21B 21/10 137/515.7 |
| 9,494,014 | B1 | 11/2016 | Manke et al. | |
| 2004/0154839 | A1 | 8/2004 | McGarian et al. | |
| 2005/0230119 | A1 | 10/2005 | McGarian et al. | |
| 2008/0302571 | A1 | 12/2008 | Mondelli et al. | |
| 2010/0155081 | A1 | 6/2010 | Mondelli et al. | |
| 2010/0161229 | A1 | 6/2010 | Georgi et al. | |
| 2011/0079435 | A1 | 4/2011 | Drenth et al. | |
| 2013/0199847 | A1 | 8/2013 | Delmar et al. | |
| 2014/0345705 | A1 | 11/2014 | Grande et al. | |
| 2015/0068812 | A1 | 3/2015 | Wesemeier et al. | |
| 2015/0345256 | A1 | 12/2015 | Tulloch | |

* cited by examiner

SUBTERRANEAN CORING ASSEMBLIES

CROSS REFERENCE TO RELATED APPLICATIONS

This application is a continuation-in-part of and claims priority to U.S. patent application Ser. No. 15/823,002, titled "Subterranean Coring Assemblies" and filed on Nov. 27, 2017, the entire contents of which are hereby incorporated herein by reference.

TECHNICAL FIELD

The present disclosure relates generally to subterranean field operations, and more specifically to assemblies used to collect core samples in a subterranean wellbore.

BACKGROUND

During subterranean field operations, data is collected to determine the composition of the formation that is being developed. Much of this data is based on measurements made by sensors that are downhole, and so calculations are often used to provide estimates. While devices and models are highly sophisticated, it is sometimes desirable to collect physical core samples that are relatively uncontaminated (for example, by circulating fluid). These core samples can be used to provide valuable information about the formation at a certain depth in the wellbore.

SUMMARY

In general, in one aspect, the disclosure relates to a subterranean coring assembly. The subterranean coring assembly can include a body having at least one wall that forms a cavity, where the cavity has a top end and a bottom end. The subterranean coring assembly can also include a first flow regulating device movably disposed within the cavity, where the first flow regulating device is configured to move from a first default position to a first operating position within the cavity based on first flow characteristics of fluid that flows into the top end of the cavity toward the bottom end of the cavity.

In another aspect, the disclosure can generally relate to a coring bottom-hole assembly (BHA). The coring BHA can include an upstream section having a first coupling feature disposed on a distal end thereof. The coring BHA can also include a downstream section having a catcher assembly, a core head, and a second coupling feature disposed on a proximal end thereof. The coring BHA can further include a subterranean coring assembly coupled to and disposed between the upstream portion and the downstream portion. The subterranean coring assembly can include a body having at least one wall that forms a cavity, where the cavity has a top end and a bottom end, where the top end includes an upstream section coupling feature, and where the bottom end includes a downstream section coupling feature. The subterranean coring assembly can also include a first flow regulating device movably disposed within the cavity, where the first flow regulating device is configured to move from a first default position to a first operating position within the cavity based on first flow characteristics of fluid that flows through the upstream section into the top end of the cavity toward the downstream section. The first operating position can correspond to a first mode of operation.

In another yet aspect, the disclosure can generally relate to a method for performing a subterranean coring operation in a wellbore. The method can include receiving fluid from an upstream section of a coring bottom hole assembly (BHA), where the fluid has a first flow rate. The method can also include moving, based on the first flow rate of the fluid, a first flow regulating device within a cavity of a body of a subterranean coring assembly. The first flow regulating device can move to a first operating position within the cavity of the body when the first flow rate of the fluid is within a first range of flow rates. The first flow regulating device can move to a second operating position within the cavity of the body when the fluid has a second flow rate, where the second flow rate is within a second range of flow rates. The first operating position can correspond to a flushing mode of operation. The second operating position can correspond to a coring mode of operation. The second flow rate can exceed the first flow rate.

These and other aspects, objects, features, and embodiments will be apparent from the following description and the appended claims.

BRIEF DESCRIPTION OF THE DRAWINGS

The drawings illustrate only example embodiments of methods, systems, and devices for subterranean coring assemblies and are therefore not to be considered limiting of its scope, as subterranean coring assemblies may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
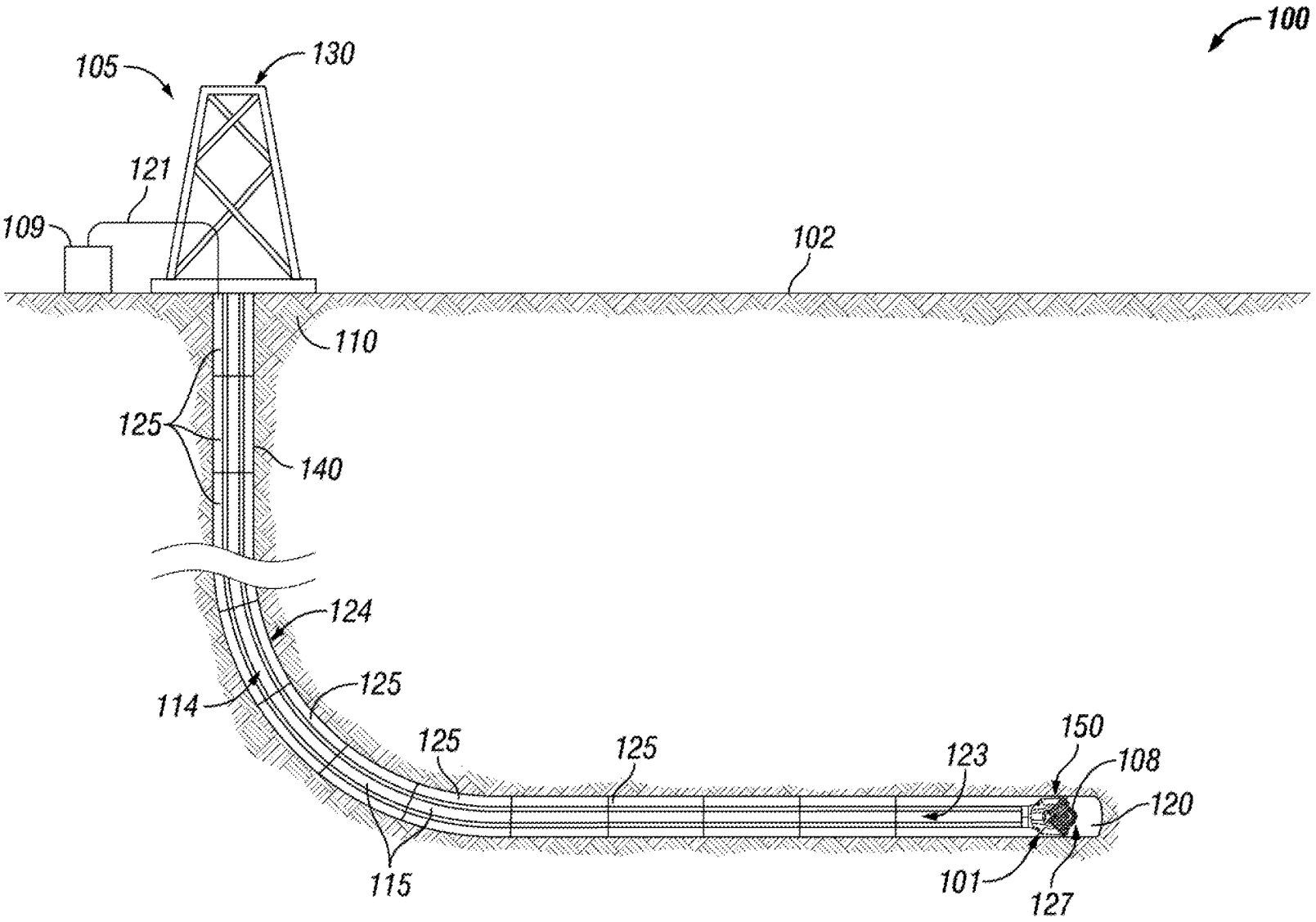
FIG. 1 shows a schematic diagram of a field system in which subterranean coring assemblies can be used in accordance with certain example embodiments.

The example embodiments discussed herein are directed to systems, apparatuses, and methods of subterranean coring assemblies. While the example coring assemblies shown in the figures and described herein are directed to use in a subterranean wellbore, example coring assemblies can also be used in other applications, aside from a wellbore, in which a core sample is needed. Thus, the examples of coring assemblies described herein are not limited to use in a subterranean wellbore. As used herein the terms "flow regulating device" and "flow regulation device" are used interchangeably.

Further, while some example embodiments described herein use hydraulic material and a hydraulic system to operate the coring assemblies described herein, example coring assemblies can also be operated using other types of systems, such as pneumatic systems. Thus, such example embodiments are not limited to the use of hydraulic material and hydraulic systems. A user as described herein may be any person that is involved with a field operation in a subterranean wellbore and/or a coring operation within the subterranean wellbore for a field system. Examples of a user may include, but are not limited to, a roughneck, a company representative, a drilling engineer, a tool pusher, a service hand, a field engineer, an electrician, a mechanic, an operator, a consultant, a contractor, and a manufacturer's representative.

Any example subterranean coring assemblies, or portions (e.g., components) thereof, described herein can be made from a single piece (as from a mold). When an example subterranean coring assembly or portion thereof is made from a single piece, the single piece can be cut out, bent, stamped, and/or otherwise shaped to create certain features, elements, or other portions of a component. Alternatively, an example subterranean coring assembly (or portions thereof) can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, fasten, and/or perform other functions aside from merely coupling. In addition, each component and/or feature described herein (including each component of an example subterranean coring assembly) can be made of one or more of a number of suitable materials, including but not limited to metal (e.g., stainless steel), ceramic, rubber, and plastic.

A coupling feature (including a complementary coupling feature) as described herein can allow one or more components and/or portions of an example subterranean coring assembly (e.g., a flow regulating device) to become mechanically coupled, directly or indirectly, to another portion (e.g., a wall) of the subterranean coring assembly and/or another component of a bottom hole assembly (BHA). A coupling feature can include, but is not limited to, a portion of a hinge, an aperture, a recessed area, a protrusion, a slot, a spring clip, a tab, a detent, and mating threads. One portion of an example subterranean coring assembly can be coupled to another portion of a subterranean coring assembly and/or another component of a BHA by the direct use of one or more coupling features.

In addition, or in the alternative, a portion of an example subterranean coring assembly can be coupled to another portion of the subterranean coring assembly and/or another component of a BHA using one or more independent devices that interact with one or more coupling features disposed on a component of the subterranean coring assembly. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

In certain example embodiments, bottom hole assemblies that include example subterranean coring assemblies are subject to meeting certain standards and/or requirements. For example, the American Petroleum Institute (API), the International Standards Organization (ISO), and the Occupational Health and Safety Administration (OSHA) set standards for subterranean field operations. Use of example embodiments described herein meet (and/or allow a corresponding device to meet) such standards when required.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of subterranean coring assemblies will be described more fully hereinafter with reference to the accompanying drawings, in which example embodiments of subterranean coring assemblies are shown. Subterranean coring assemblies may, however, be embodied in many different forms and should not be construed as limited to the example embodiments set forth herein. Rather, these example embodiments are provided so that this disclosure will be thorough and complete, and will fully convey the scope of subterranean coring assemblies to those of ordinary skill in the art. Like, but not necessarily the same, elements in the various figures are denoted by like reference numerals for consistency.

Terms such as "first", "second", "end", "inner", "outer", "top", "bottom", "upward", "downward", "up", "down", "distal", and "proximal" are used merely to distinguish one component (or part of a component or state of a component) from another. Such terms are not meant to denote a preference or a particular orientation. Also, the names given to various components described herein are descriptive of one embodiment and are not meant to be limiting in any way. Those of ordinary skill in the art will appreciate that a feature and/or component shown and/or described in one embodiment (e.g., in a figure) herein can be used in another embodiment (e.g., in any other figure) herein, even if not expressly shown and/or described in such other embodiment.

FIG. 1 shows a schematic diagram of a land-based field system 100 in which coring assemblies can be used within a subterranean wellbore in accordance with one or more example embodiments. Referring to FIG. 1, the field system 100 in this example includes a wellbore 120 that is formed by a wall 140 in a subterranean formation 110 using field equipment 130. The field equipment 130 can be located above a surface 102, and/or within the wellbore 120. The surface 102 can be ground level for an on-shore application and the sea floor for an off-shore application. The point where the wellbore 120 begins at the surface 102 can be called the entry point.

The subterranean formation 110 can include one or more of a number of formation types, including but not limited to shale, limestone, sandstone, clay, sand, and salt. In certain embodiments, a subterranean formation 110 can also include one or more reservoirs in which one or more resources (e.g., oil, gas, water, steam) can be located. One or more of a number of field operations (e.g., coring, tripping, drilling, setting casing, extracting downhole resources) can be performed to reach an objective of a user with respect to the subterranean formation 110.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., insert casing pipe, extract downhole materials) the wellbore 120. The field equipment 130 can be positioned and/or assembled at the surface 102. The field equipment 130 can include, but is not limited to, a circulation unit 109 (including circulation line 121, as explained below), a derrick, a tool pusher, a clamp, a tong, drill pipe, a drill bit, example isolator subs, tubing pipe, a power source, and casing pipe.

The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of casing pipe to be inserted at a certain depth in the wellbore 120.

Inserted into and disposed within the wellbore 120 of FIG. 1 are a number of casing pipe 125 that are coupled to each other to form the casing string 124. In this case, each end of a casing pipe 125 has mating threads (a type of coupling feature) disposed thereon, allowing a casing pipe 125 to be mechanically coupled to an adjacent casing pipe 125 in an end-to-end configuration. The casing pipes 125 of the casing string 124 can be mechanically coupled to each other directly or using a coupling device, such as a coupling sleeve. The casing string 124 is not disposed in the entire wellbore 120. Often, the casing string 124 is disposed from approximately the surface 102 to some other point in the wellbore 120. The open hole portion 127 of the wellbore 120 extends beyond the casing string 124 at the distal end of the wellbore 120.

Each casing pipe 125 of the casing string 124 can have a length and a width (e.g., outer diameter). The length of a casing pipe 125 can vary. For example, a common length of a casing pipe 125 is approximately 40 feet. The length of a casing pipe 125 can be longer (e.g., 60 feet) or shorter (e.g., 10 feet) than 40 feet. The width of a casing pipe 125 can also vary and can depend on the cross-sectional shape of the casing pipe 125. For example, when the cross-sectional shape of the casing pipe 125 is circular, the width can refer to an outer diameter, an inner diameter, or some other form of measurement of the casing pipe 125. Examples of a width in terms of an outer diameter can include, but are not limited to, 7 inches, 7⅝ inches, 8⅝ inches, 10¾ inches, 13⅜ inches, and 14 inches.

The size (e.g., width, length) of the casing string 124 can be based on the information gathered using field equipment 130 with respect to the wellbore 120. The walls of the casing string 124 have an inner surface that forms a cavity 123 that traverses the length of the casing string 124. Each casing pipe 125 can be made of one or more of a number of suitable materials, including but not limited to stainless steel. In certain example embodiments, each casing pipe 125 is made of one or more of a number of electrically conductive materials.

A number of tubing pipes 115 that are coupled to each other and inserted inside the cavity 123 form the tubing string 114. The collection of tubing pipes 115 can be called a tubing string 114. The tubing pipes 115 of the tubing string 114 are mechanically coupled to each other end-to-end, usually with mating threads (a type of coupling feature). The tubing pipes 115 of the tubing string 114 can be mechanically coupled to each other directly or using a coupling device, such as a coupling sleeve or an isolator sub (both not shown). Each tubing pipe 115 of the tubing string 114 can have a length and a width (e.g., outer diameter). The length of a tubing pipe 115 can vary. For example, a common length of a tubing pipe 115 is approximately 30 feet. The length of a tubing pipe 115 can be longer (e.g., 40 feet) or shorter (e.g., 10 feet) than 30 feet. Also, the length of a tubing pipe 115 can be the same as, or different than, the length of an adjacent casing pipe 125.

The width of a tubing pipe 115 can also vary and can depend on one or more of a number of factors, including but not limited to the target depth of the wellbore 120, the total length of the wellbore 120, the inner diameter of the adjacent casing pipe 125, and the curvature of the wellbore 120. The width of a tubing pipe 115 can refer to an outer diameter, an inner diameter, or some other form of measurement of the tubing pipe 115. Examples of a width in terms of an outer diameter for a tubing pipe 115 can include, but are not limited to, 7 inches, 5 inches, and 4 inches.

In some cases, the outer diameter of the tubing pipe 115 can be such that a gap exists between the tubing pipe 115 and an adjacent casing pipe 125. The walls of the tubing pipe 115 have an inner surface that forms a cavity that traverses the length of the tubing pipe 115. The tubing pipe 115 can be made of one or more of a number of suitable materials, including but not limited to steel.

At the distal end of the tubing string 114 within the wellbore 120 is a BHA 101. The BHA 101 can include a coring assembly 150 and a coring bit 108 at the far distal end. The coring bit 108 is used to create and retain a sample (a core) of the subterranean formation 110 in the open hole portion 127 of the wellbore 120 by cutting into the formation 110. The BHA 101 can also include one or more other components, including but not limited to an operating tool 107, one or more tubing pipes 115, one or more stabilizers, and an example coring assembly 150. An example of a BHA 101 is shown below with respect to FIG. 2. During a field operation that involves coring, the tubing string 114, including the BHA 101, can be rotated by other field equipment 130.

The circulation unit 109 can include one or more components that allow a user to control the coring assembly 150 from the surface 102. Examples of such components of the circulation unit 109 can include, but are not limited to, a compressor, one or more valves, a pump, piping, and a motor. The circulating line 121 transmits fluid from the circulating unit 109 downhole to the coring assembly 150.

Figure 2A:
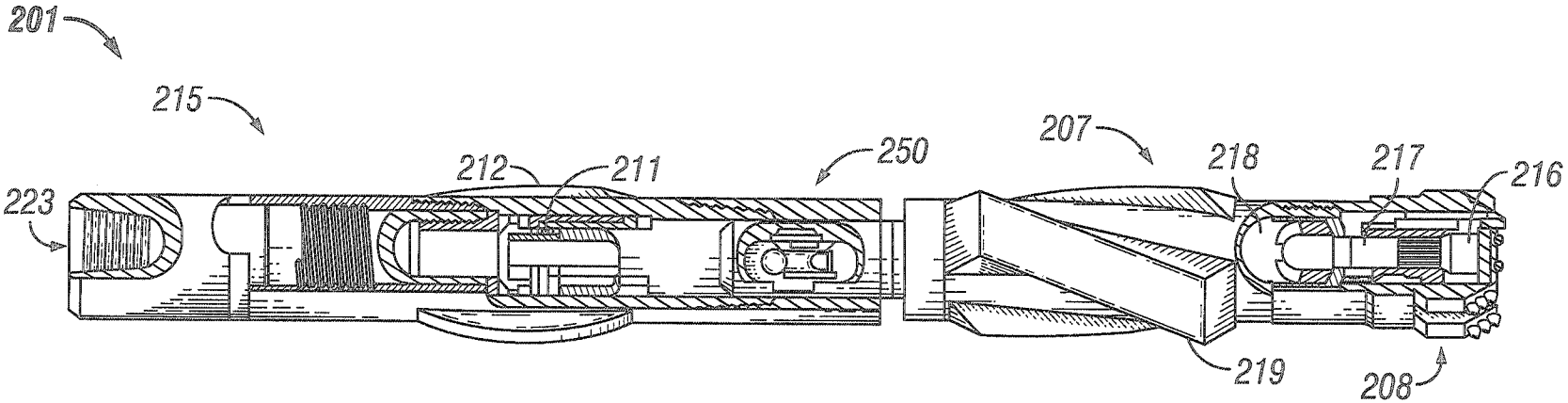
FIG. 2A PRIOR ART
FIGS. 2A-2C show a bottom hole assembly that includes a subterranean coring assembly currently used in the art.
Figure 2B:
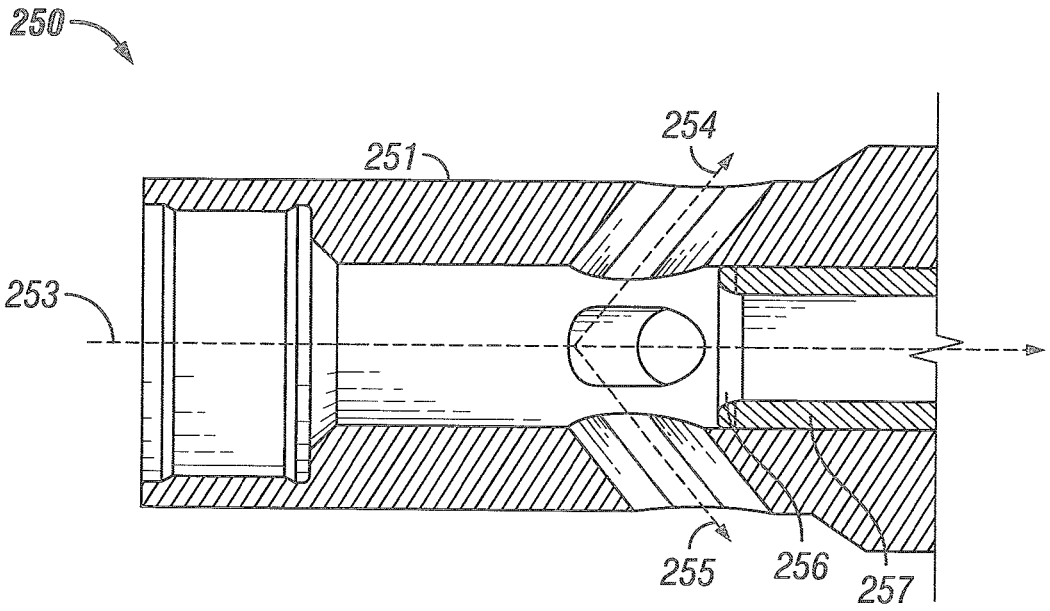
FIG. 2B PRIOR ART
Figure 2C:
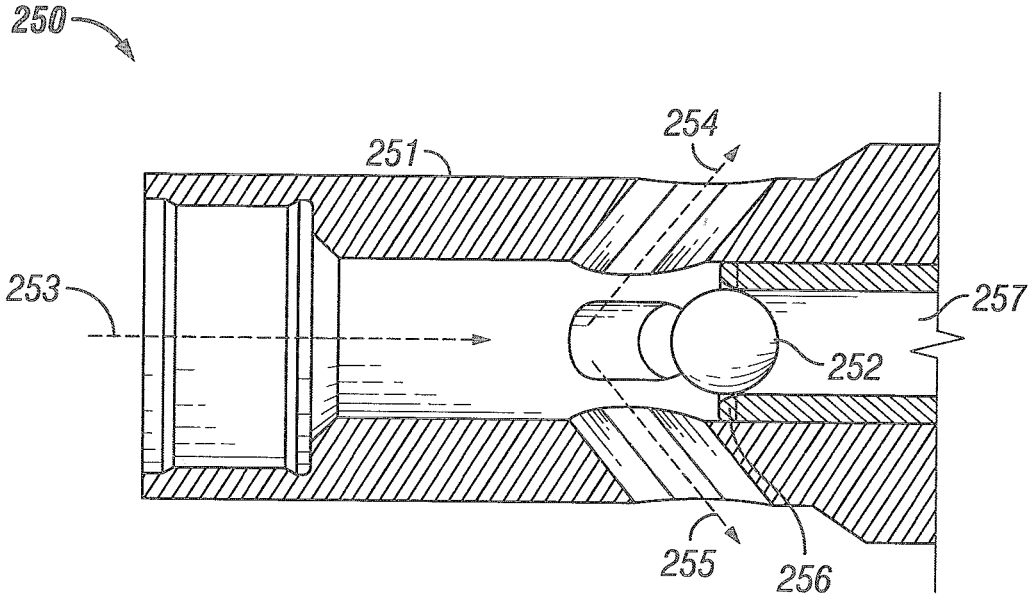
FIG. 2C PRIOR ART

FIGS. 2A-2C show a BHA 201 that includes a subterranean coring assembly 250 currently used in the art. Specifically, FIG. 2A shows a cross-sectional side view of the bottom hole assembly 201. FIG. 2B shows a cross-sectional side view of the subterranean coring assembly 250 in a fully flowing state. FIG. 2C shows a cross-sectional side view of the subterranean coring assembly 250 in a partially flowing state. The arrows in FIGS. 2B and 2C show the flow of fluid through the coring assembly 250. Referring to FIGS. 1-2C, the BHA 201 of FIGS. 2A-2C includes an upstream section 215 and a downstream section 207, with the subterranean coring assembly 250 disposed therebetween.

Best practices for conventional coring flushes the inner portions of the coring assembly 250 with non-contaminated coring fluid before initiating the coring process. Best practices for coring also prevent fluid flow throughout the inner portions of the coring assembly 250 while the coring operation is being performed. Best practices for coring further allow fluid and gases to exit the inner portions of the coring assembly 250 as the coring assembly 250, after being used to capture a core, is tripped to the surface 102. Finally, best practices for coring require that all settings need to be made in a timely manner.

The flushing of the inner portions of the coring assembly 250 is accomplished by pumping fluid down through a ported pressure relief valve 257 of the coring assembly 250. The pressure relief valve 257 is adjacent to the seat 256 of the inner tube plug of the coring assembly 250. In certain example embodiments, the seat 256 is located at the top side of the pressure relief valve 257. Once the inner portions of the coring assembly 250 are flushed then a diversion ball 252 is launched from the surface 102 to isolate the pressure relief valve 257 from any fluid flow. Specifically, as shown in FIG. 2C, the diversion ball 252 lands onto the ball seat 256 on the top side of the pressure relief valve 257. When this occurs, all flow of the fluid is diverted from channel 253 defined by the body 251 of the coring assembly 250 through one or more inner tube plug ports (in this case, inner tube plug port 254 and inner tube plug port 255). The inner tube plug ports 254, 255 divert the fluid to the annulus between the outer surface of the coring assembly 250 and the inner surface of the downstream section 207, eventually exiting through the core head 216 of the core bit 208.

During the coring process, the trapped fluid within the space that holds the pressure relief valve 257 is displaced by the core as the coring assembly 250 slides over the core. The displaced fluid exits the coring assembly 250 through the catcher assembly 217 of the downstream section 207 and then through the face of the core head 216. The core, once captured, is disposed within the catcher assembly 217. Once coring is completed, the BHA 201 is tripped to surface 102. As the hydrostatic pressure decreases, compressed fluids and gases within the core expand, exit the core, and unseat the diversion ball 252 to exit the coring assembly 250. The diversion ball 252 is typically 1" to 1¼" in diameter.

In addition to the core head 216 and the catcher assembly 217, the coring bit 208 can include one or more of a number of other components. For example, as shown in FIG. 2A, the coring bit 208 can include an inner tube assembly 218. The coring bit 208 is disposed at the distal end of the downstream section 207. The downstream section 207 can also include a stabilizer 219. The upstream section 215 can include one or more of a number of other components. For example, as shown in FIG. 2A, the upstream section 215 can include a bearing assembly 211 and an outer core barrel stabilizer 212.

Whenever there is an obstruction in the tubing string 114, including the BHA 201, that does not allow the diversion ball 252 to pass, the diversion ball 252 is run in place on the pressure relief valve ball seat 256. If this occurs, then best industry practices are not followed because the inner portions of the coring assembly 250 are not being flushed before the coring process begins. Not flushing the inner portions of the coring assembly 250 may allow debris from the trip into the hole or debris from the open hole portion 127 of the wellbore 120 when flushed to be held inside the inner portions of the coring assembly 250 within the viscous coring fluid. In such a case, the debris within the coring fluid inside the coring assembly 250 displaces with the coring fluid as the coring assembly 250 slides over the core. This may cause the coring assembly 250 to jam in the annulus between the inner assembly ID and the core OD because oversized debris particles may travel freely, and the particles may engage the core and the ID of the inner assembly and wedge. The wedging of the particles between the core and the inner assembly ID is what actually jams. The distance of annulus between the core and the inner assembly ID can vary. For example, such a distance can range between 1.7 mm and 12.7 mm.

Further, depending on the length of the wellbore 120, it can take 30 minutes or more from the time that the diversion ball 252 is released at the surface 102 to when the diversion ball 252 becomes lodged in the seat 256. Such an excessive amount of time leads to money spent on personnel and equipment that is sitting idle waiting for the diversion ball 252 to find the seat 256 so that the coring operation can begin.

Figure 3A:
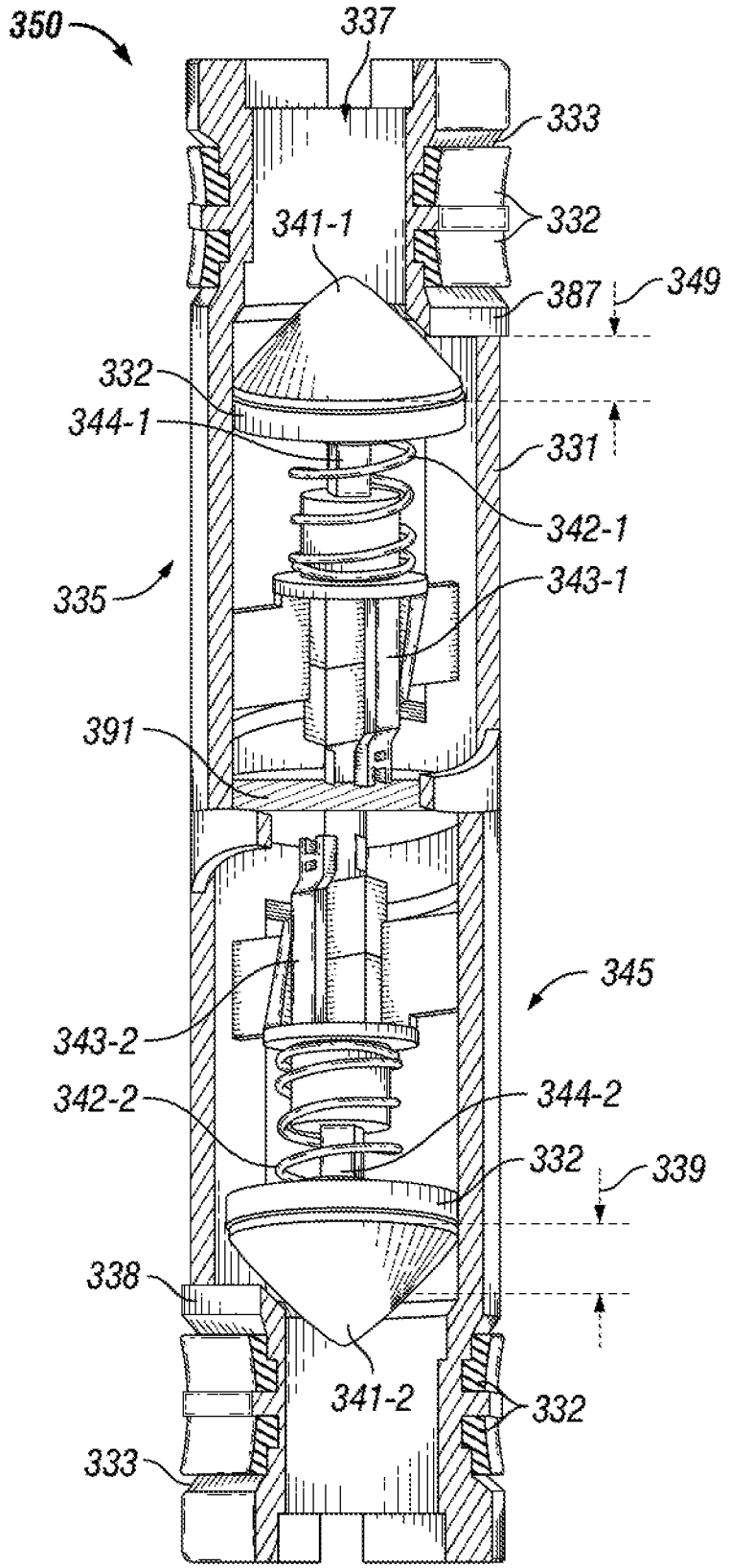
FIG. 3A shows a subterranean coring assembly configured in a default position in accordance with certain example embodiments.
Figure 3B:
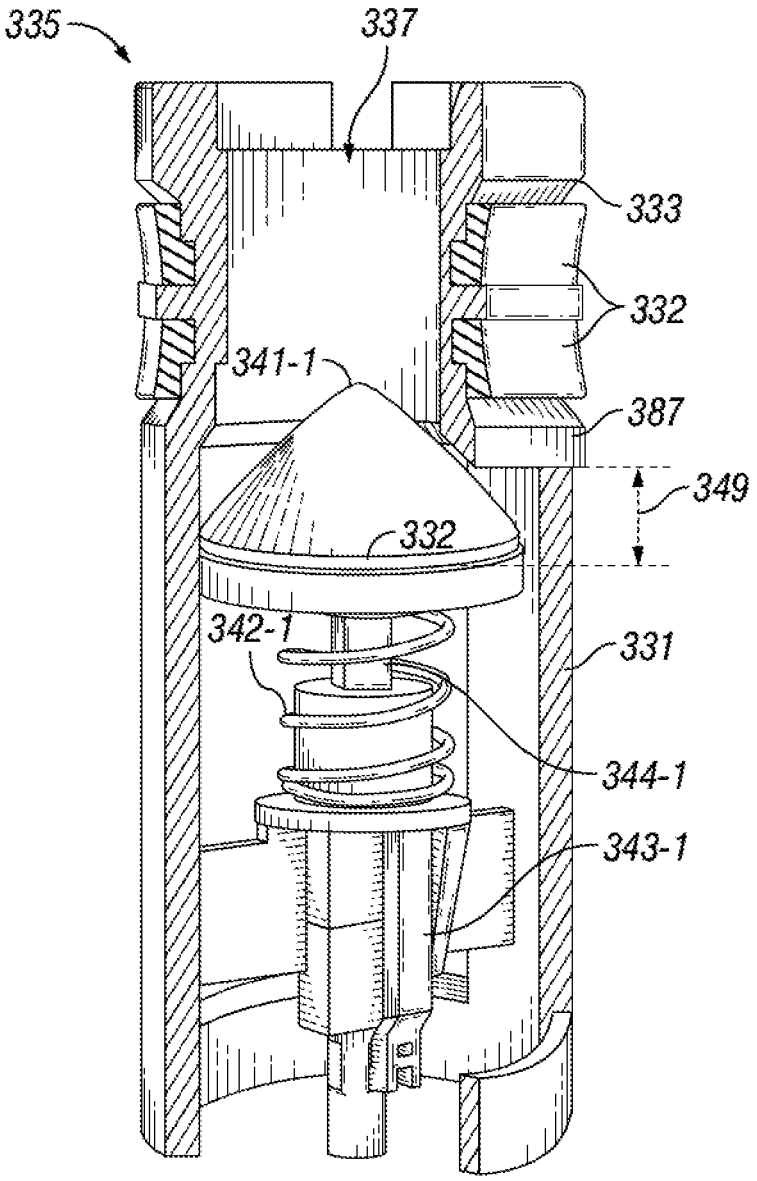
FIG. 3B shows a portion of the subterranean coring assembly of FIG. 3A.

FIGS. 3A and 3B show a subterranean coring assembly 350 configured in a default position in accordance with certain example embodiments. Specifically, FIG. 3A shows a cross-sectional side view of the example coring assembly 350. FIG. 3B shows a cross-sectional side view of a flow regulating device 335 of the coring assembly 350 of FIG. 3A. Referring to FIGS. 1-3B, the coring assembly 350 of FIGS. 3A and 3B is configured differently from the coring assembly 250 of FIGS. 2A-2C.

For example, the example coring assembly 350 of FIGS. 3A and 3B can include one or more flow regulating devices (e.g., flow regulating device 335, flow regulating device 345) that remain within the cavity 337 formed by the one or more walls 331 (also called a body 331 of the coring assembly 350) during all modes of operation (e.g., tripping mode of operation, flushing mode of operation, coring mode of operation). In other words, example embodiments do not rely upon some object or component (e.g., a diversion ball 252) to be delivered from the surface 102 in order to use the coring assembly for a different mode of operation in the field.

Figure 11A:
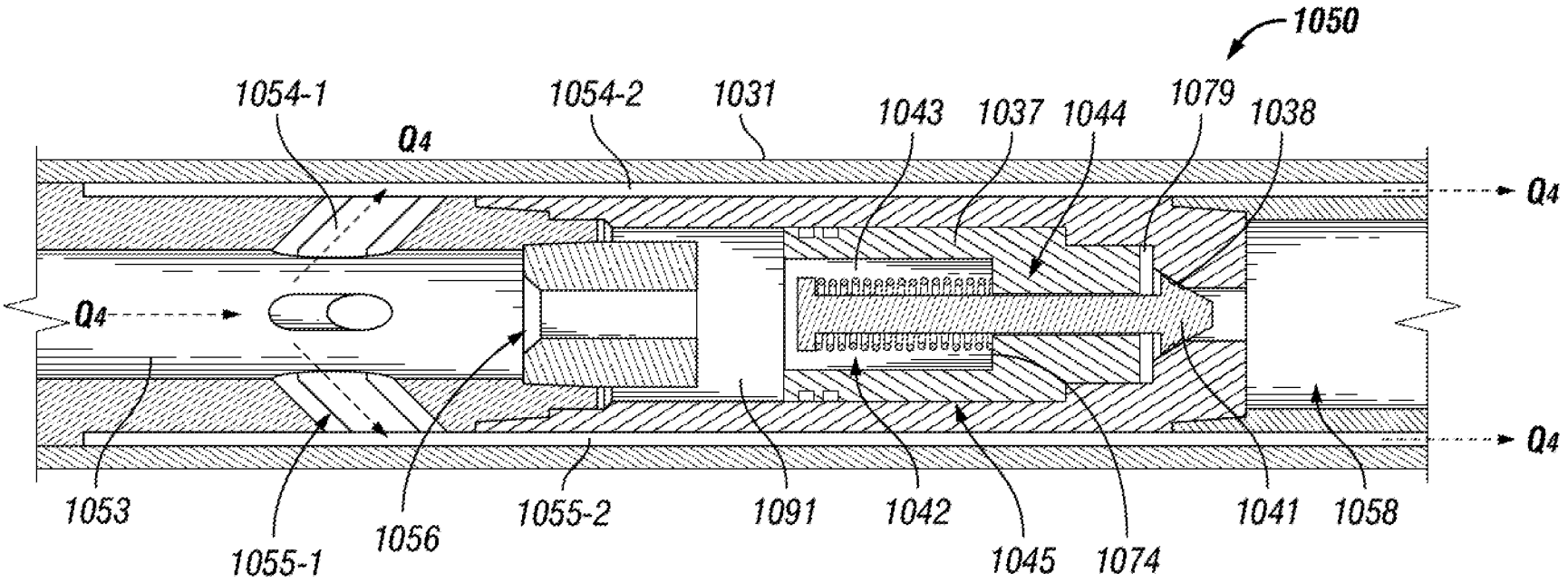
FIGS. 11A and 11B show the subterranean coring assembly of FIGS. 10A and 10B in a closed position in accordance with certain example embodiments.

As shown in FIGS. 3A-9 below, a flow regulating device can have any of a number of configurations. In this example, the two flow regulating devices (flow regulating device 335 and flow regulating device 345) are float valves that are inverted relative to each other. Specifically, flow regulating device 335 is oriented normally (into the flow of fluid through the coring assembly 350), and flow regulating device 345 is inverted (with the flow of fluid through the coring assembly 350). While float valves are normally used is subterranean field operations, in the current art they are run inside of a float sub and run in drilling BHAs and/or in coring BHAs above the coring assembly. Here, in example embodiments, two float valves are used in a novel configuration housed within a modified float sub that is incorporated within the coring assembly to act as a flow regulating device for a coring operation. For instance, example embodiments discussed herein, such as what is shown in FIGS. 3A and 11A below, can be disposed within the inner assembly below the ports which direct flow to the annulus between the outer assembly inside diameter and the inner assembly outside diameter.

Each float valve in FIG. 3A has a number of components. For example, the float valve that serves as flow regulating device 335 of FIGS. 3A and 3B includes a conically shaped plunger valve 341-1, around the base of which is disposed an optional sealing member 332 (e.g., a gasket, an O-ring), a base 343-1, and a variable length extension 344-1 disposed between the base 343-1 and the plunger valve 341-1. The flow regulating device 335 of FIGS. 3A and 3B also includes a resilient device 342-1 wrapped around the extension 344-1 and disposed between the base 343-1 and the plunger valve 341-1. In some cases, the resilient device 342-1 can be combined with the extension 344-1 and/or the base 343-1. The resilient device 342-1, working in conjunction with the extension 344-1, is used to control the position of the flow regulating device 335 within the cavity 337.

Similarly, flow regulating device 345 of FIGS. 3A and 3B includes a conically shaped plunger valve 341-2, around the base of which is disposed an optional sealing member 332 (e.g., a gasket, an O-ring), a base 343-2, and a variable length extension 344-2 disposed between the base 343-2 and the plunger valve 341-2. The flow regulating device 345 of FIGS. 3A and 3B also includes a resilient device 342-2 wrapped around the extension 344-2 and disposed between the base 343-2 and the plunger valve 341-2. The resilient device 342-2, working in conjunction with the extension 344-2, is used to control the position of the flow regulating device 345 within the cavity 337.

The plunger valve 341-1 of flow regulating device 335 is directed toward the proximal end of the flow regulating device 335 (the end that couples to the upstream section of the BHA 101), and the plunger valve 341-2 of flow regulating device 345 is directed toward the distal end of the flow regulating device 345 (the end that couples to the downstream section of the BHA 101). In certain example embodiments, as shown in FIG. 3A, there is a stroke restrictor 391 disposed within the cavity 337 between two flow regulating devices (flow regulating device 335 and flow regulating device 345 in this case). In such a case, the stroke restrictor 391 can be used to anchor the opposing flow regulating devices and prevent one from interfering with the other by limiting the range of motion of each flow regulating device. There can additionally or alternatively be one or more of a number of other components that can be used to secure one or more flow regulating devices within the cavity 337, including but not limited to braces, brackets, and fastening devices.

In this example, the base 343-1 of flow regulating device 335 is coupled to the top end of the stroke restrictor 391, and the base 343-2 of flow regulating device 345 is coupled to the bottom end of the stroke restrictor 391. The stroke restrictor 391 can have any of a number of components and/or configurations. For example, the stroke restrictor 391 can include a bracket, a plate, and/or a sleeve. The stroke restrictor 391 can be coupled to a flow regulating device and the wall 331 of the coring assembly 350 using any of a number of coupling means, including but not limited to welding and fastening devices (e.g., bolts, rivets).

There can also be one or more other stroke restrictors disposed within the cavity 337 of the coring assembly 350 that can be used to restrict movement of a different component of a flow regulating device. For example, stroke restrictor 387 can be used to restrict how far flow regulating device 335 can extend within the cavity 337. Specifically, stroke restrictor 387 can be configured to receive a portion of the plunger valve 341-1 of flow regulating device 335 without the plunger valve 341-1 actually making contact with the stroke restrictor 387. There are several purposes for always having a gap between the plunger valve 241-1 and the stroke restrictor 387. For example, when tripping out with the core, the gap between the plunger valve 241-1 and the stroke restrictor 387 allows for the expanding fluids and gases to escape.

The stroke restrictor 387 can have any of a number of components and/or configurations. For example, the stroke restrictor 387 can include a plate or a sleeve. In this case, the stroke restrictor 387 is a plate having an aperture disposed therethrough, where the aperture receives a portion of the plunger valve 341-1. The stroke restrictor 387 can be coupled to the wall 331 of the coring assembly 350 using any of a number of coupling means.

As another example, stroke restrictor 338 can be used to restrict how far flow regulating device 345 can extend within the cavity 337. Specifically, stroke restrictor 338 can be configured to receive the plunger valve 341-2 of flow regulating device 345 so that, when the plunger valve 341-2 abuts against the stroke restrictor 338, no fluid can flow beyond that point in the cavity 337. The stroke restrictor 338 can have any of a number of components and/or configurations. For example, the stroke restrictor 338 can include a plate or a sleeve. In this case, the stroke restrictor 338 is a plate having an aperture disposed therethrough, where the aperture receives a portion of the plunger valve 341-2. The stroke restrictor 338 can be coupled to the wall 331 of the coring assembly 350 using any of a number of coupling means.

As discussed above, each flow regulating device of the coring assembly 350 is movable within the cavity 337 of the coring assembly 350. The position of a flow regulating device within the cavity 337 can regulate the amount of fluid that flows through that portion of the cavity 337. In this case, the plunger valve 341-1 of flow regulating device 335 can move toward and away from the base 343-1, which is anchored to the top side of the stroke restrictor 391, and the plunger valve 341-2 of flow regulating device 345 can move toward and away from the base 343-2, which is anchored to the bottom side of the stroke restrictor 391.

The position of a flow regulating device (or portion thereof) within the cavity 337 can be measured or defined in any of a number of ways. For example, the position of flow regulating device 335 can be defined as the distance 349 between the stroke restrictor 387 and the base of the plunger valve 341-1. In FIGS. 3A and 3B, which show flow regulating device 335 in a default position, the position of flow regulating device 335 is defined by distance 349. Similarly, as shown in FIG. 3A, the position of flow regulating device 345 can be defined as the distance 339 between the stroke restrictor 338 and the base of the plunger valve 341-2. In FIG. 3A, which shows flow regulating device 345 in a default position, the position of flow regulating device 345 is defined by distance 339.

The movement of flow regulating device 335 and flow regulating device 345 (and any other applicable flow regulating devices if the coring assembly 350 has more than two) can be independent of each other. The position of a flow regulating device of the coring assembly 350 can be adjusted in any one or more of a number of ways. For example, in this case, the position of flow regulating device 335 and flow regulating device 345 is adjusted using the flow rate of the fluid flowing through cavity 337 of the coring assembly 350. The position of a flow regulating device of the coring assembly 350 can additionally or alternatively be adjusted and controlled hydraulically (e.g., using pneumatic lines) or electronically (e.g., using a motor disposed within the base 343 of a flow regulating device).

In these latter examples, a controller can be used to control the position of a flow regulating device. Such a controller can include one or more of a number of components, including but not limited to a hardware processor, a memory, a control engine, a storage repository, a communication module, a transceiver, a timer, a power module, and an application interface. In addition, in these latter examples, the controller can work in conjunction with one or more other components, including but not limited to sensors, electrical cables, hydraulic lines, motors, compressors, and switches.

The example coring assembly 350 can have any of a number of other features. For example, as shown in FIGS. 3A and 3B, there can be a number of channels 333 disposed along the outer surface of the wall 331 of the coring assembly 350. In such a case, one or more sealing members 332 (e.g., gaskets, O-rings) can be disposed within a channel 333 to provide a seal between the coring assembly 350 and another component of the BHA.

Figure 4:
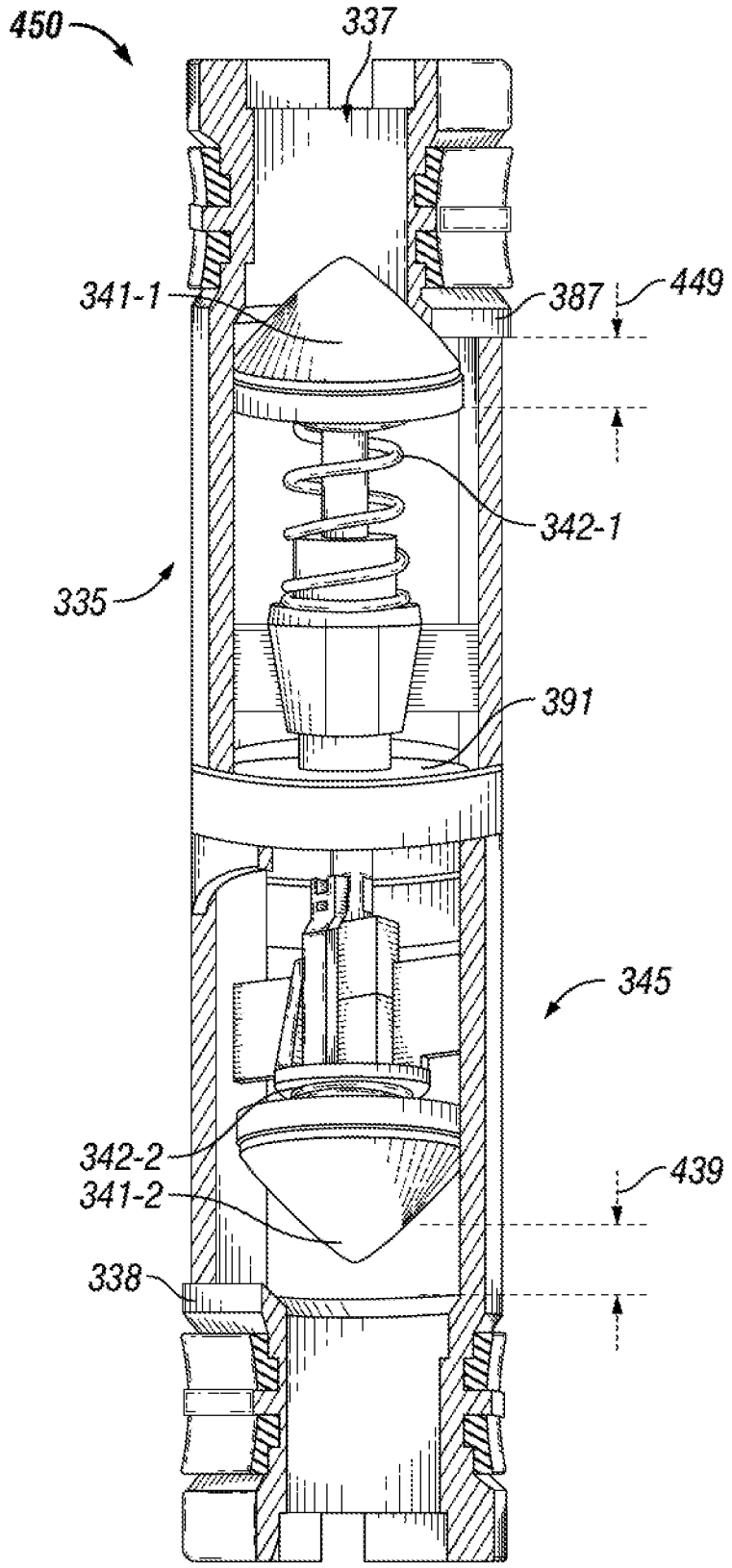
FIG. 4 shows a cross-sectional side view of another subterranean coring assembly configured in a default position in accordance with certain example embodiments.
Figure 5:
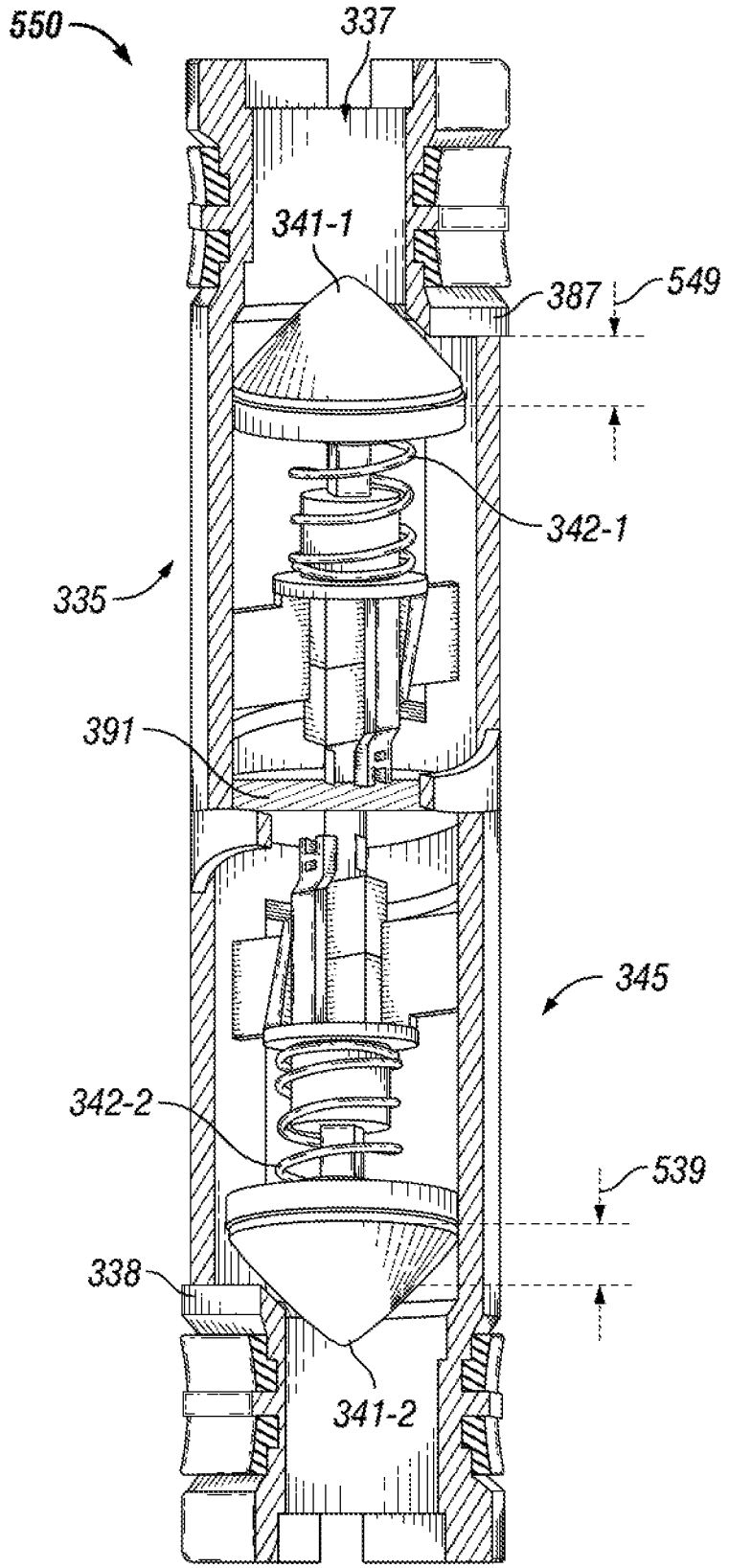
FIG. 5 shows the subterranean coring assembly of FIGS. 3A and 3B configured in a first mode of operation.
Figure 6:
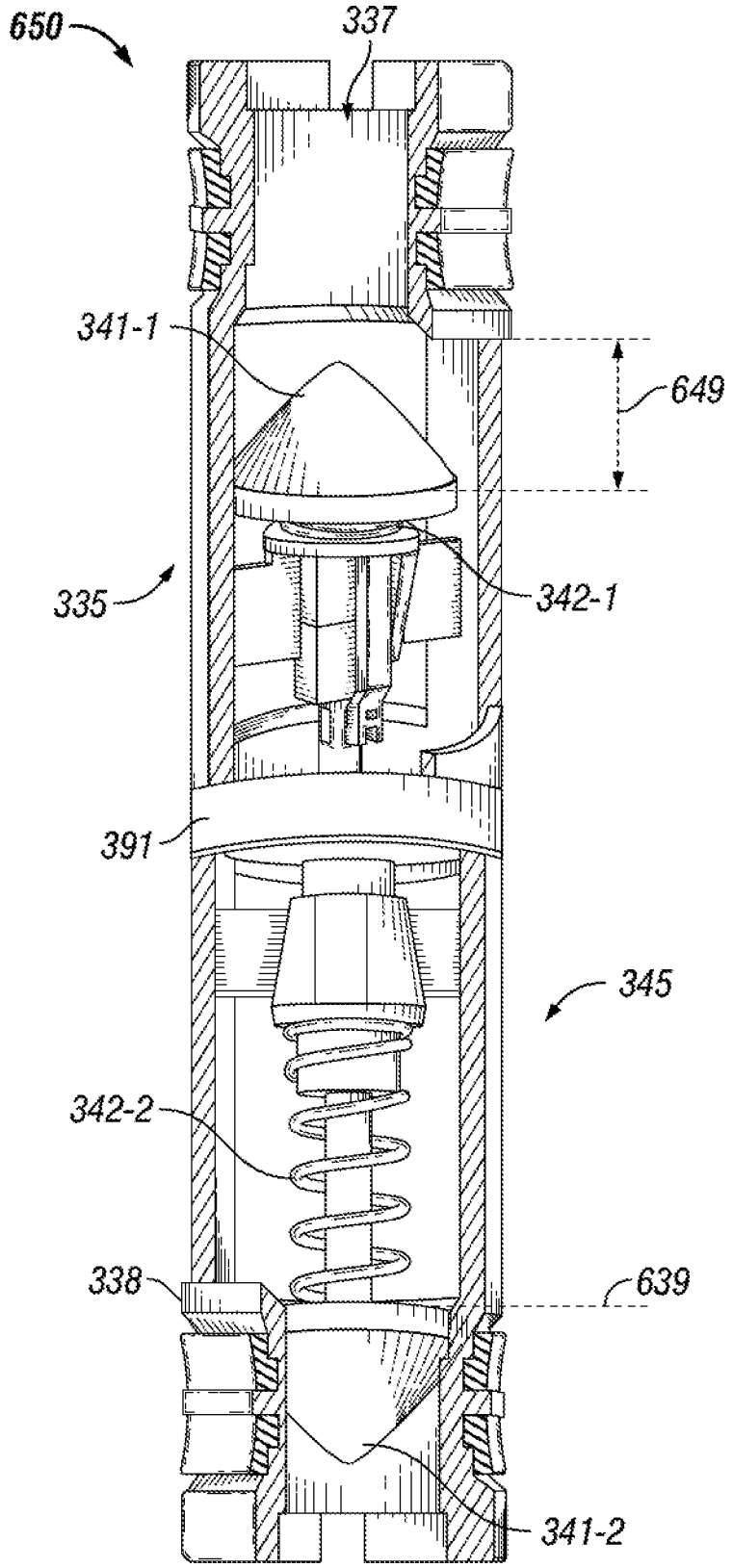
FIG. 6 shows the subterranean coring assembly of FIGS. 3A and 3B configured in a second mode of operation.

The position of each flow regulating device can vary based on, for example, the mode of operation and the flow rate of the fluid used during that mode of operation. FIG. 4 shows the subterranean coring assembly 450 of FIGS. 3A and 3B configured in a first mode of operation. FIG. 5 shows the subterranean coring assembly 550 of FIGS. 3A and 3B configured in a second mode of operation. FIG. 6 shows the subterranean coring assembly 650 of FIGS. 3A and 3B configured in a third mode of operation.

Referring to FIGS. 1-6, the first mode of operation shown in FIG. 4 is a tripping operation, where the BHA (which includes the coring assembly 450) is being inserted into the wellbore 120 toward the open hole portion 127. When this occurs, the position of flow regulating device 335 is defined by distance 449, which is equal to distance 349 (the default position of flow regulating device 335), and the position of flow regulating device 345 is defined by distance 439, which is equal to distance 339 (the default position of flow regulating device 345). During a tripping operation, fluid is allowed to circulate through the cavity 337 of the coring assembly 450. When tripping out (pulling out of the wellbore 120), expanding gas and fluid is able to exit the cavity 337.

The second mode of operation shown in FIG. 5 is a flushing operation, as described above with respect to FIGS. 2A-2C. When this occurs, the position of flow regulating device 335 is defined by distance 549, which is greater than distance 449 (the position of flow regulating device 335 during the tripping operation), and the position of flow regulating device 345 is defined by distance 539, which is less than distance 439 (the position of flow regulating device 345 during the tripping operation).

A flushing operation is performed just prior to the start of coring. During a flushing operation, the mud pumps (part of the field equipment 130 at the surface 102) pump fluid at a flow rate sufficient to push the fluid through the cavity 337 of the coring assembly 550, through the inner tube assembly (e.g., inner tube assembly 718 of FIG. 7 below), and exits out the catcher assembly (e.g., catcher assembly 717 of FIG. 7 below). To accomplish this coring operation, the tension in the resilient device 342-1 of the flow regulation device 335 must be known or calculated to compress a certain amount at a given flow rate. In other words, it is important to know the characteristics of the resilient devices 342 in order to control the position of flow regulation device 335 (defined by distance 549) and the position of flow regulation device 345 (defined by distance 539) within the cavity 337. The flow of fluid entering the coring assembly 550 can be concentrated to strike a portion of the surface area of the plunger valve 341-1 of the flow regulation device 335.

The third mode of operation shown in FIG. 6 is a coring operation, as described above with respect to FIGS. 2A-2C. When this occurs, the position of flow regulating device 335 is defined by distance 649, which is greater than distance 549 (the position of flow regulating device 335 during the flushing operation), and the position of flow regulating device 345 is defined by distance 639, which is less than distance 539 (the position of flow regulating device 345 during the flushing operation). In fact, during the coring operation, the distance 639 is substantially zero, preventing substantially any fluid from flowing through the aperture in the stroke restrictor 338.

During the coring operation, the flow rate of the fluid flowing through the cavity 337 is high, which forces the flow regulation device 345 to close off at the stroke restrictor 338. Specifically, the cavity 337 of the coring assembly 650 becomes sealed off from the flow of fluid because the force applied to the plunger valve 341-1 of the flow regulation device 335 has compressed the resilient device 342-1, allowing the plunger valve 341-2 of the flow regulation device 345 to seat against the stroke restrictor 338 and create a seal.

Figure 7:
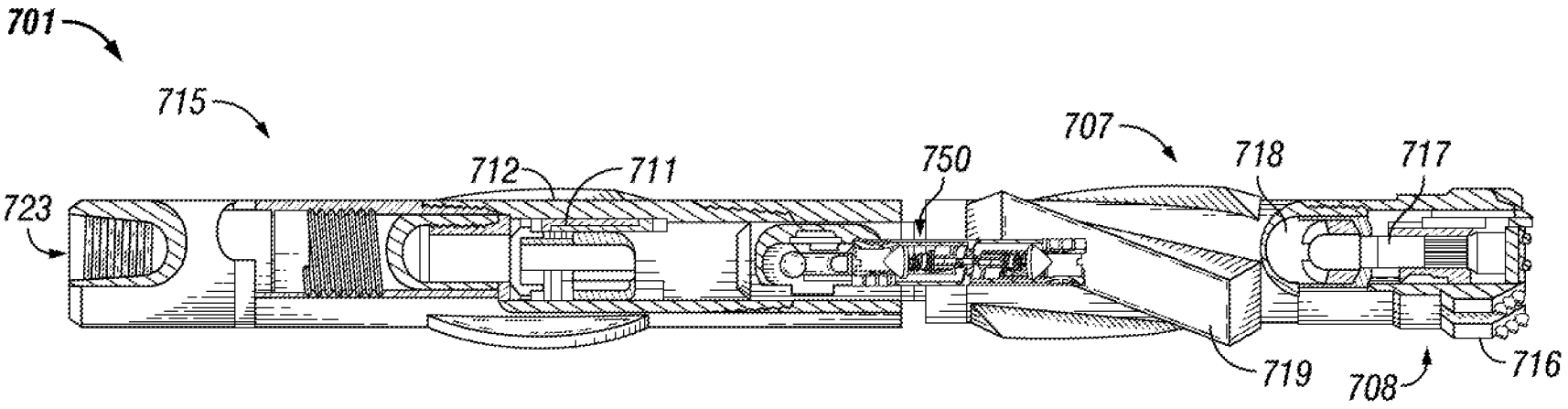
FIG. 7 shows a bottom-hole assembly that includes a subterranean coring assembly in accordance with certain example embodiments.

FIG. 7 shows a cross-sectional side view of a bottom-hole assembly 701 that includes a subterranean coring assembly 750 in accordance with certain example embodiments. Referring to FIGS. 1-7, the BHA 701 of FIG. 7 is substantially the same as the BHA 201 of FIG. 2A, except as described below. For example, the BHA 701 of FIG. 7 includes an upstream section 715 and a downstream section 707, with the subterranean coring assembly 750 disposed therebetween. The upstream section 715 in this case includes a bearing assembly 711 and an outer core barrel stabilizer 712, and the downstream section 707 includes a stabilizer 719 and a coring bit 708, which includes a core head 716, a catcher assembly 717, and an inner tube 718. In this case, the coring assembly 750 of FIG. 7 is substantially the same as the example coring assembly of FIGS. 3A-6.

Figure 8:
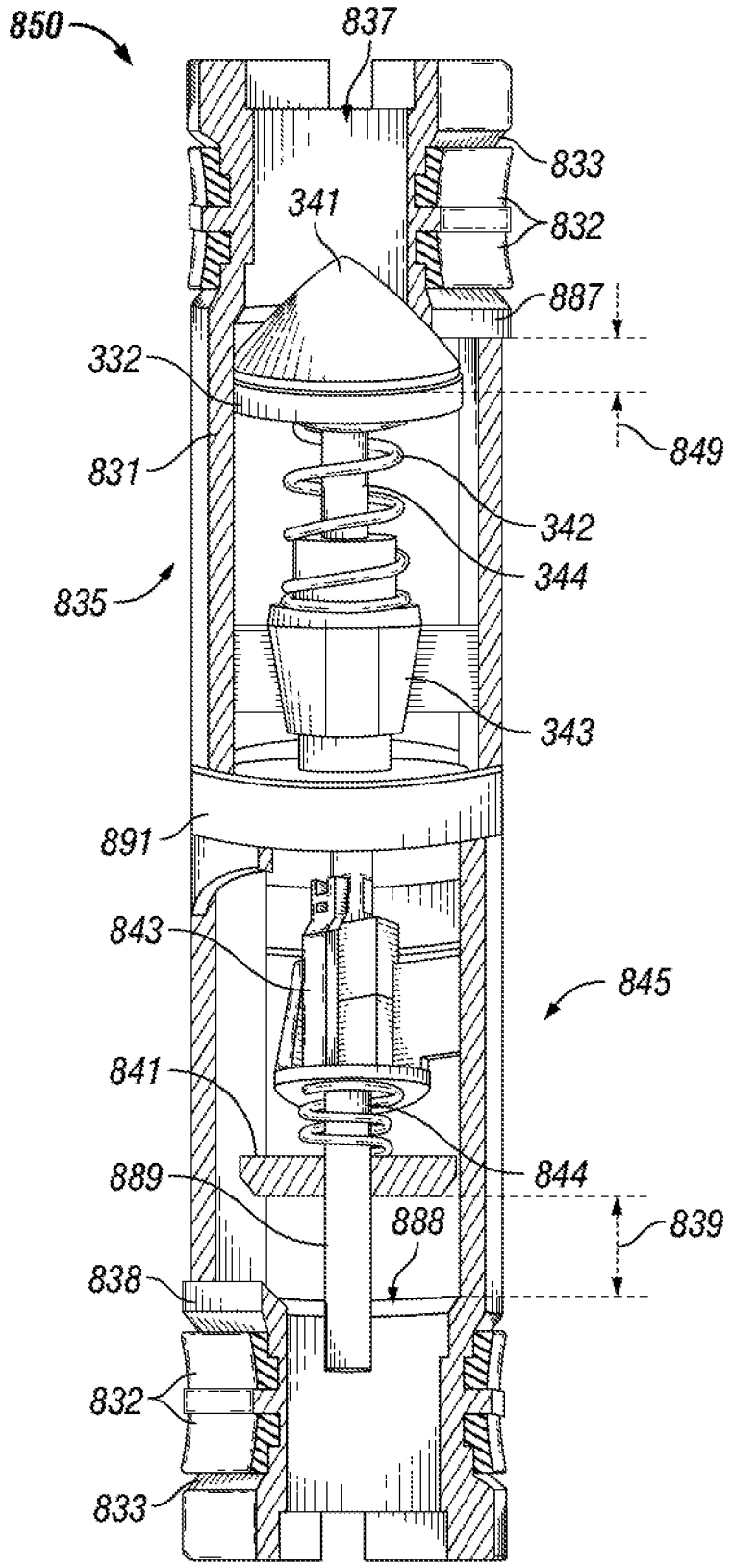
FIG. 8 shows yet another subterranean coring assembly configured in a default position in accordance with certain example embodiments.

FIG. 8 shows another subterranean coring assembly 850 configured in a default position in accordance with certain example embodiments. Referring to FIGS. 1-8, the coring assembly 850 of FIG. 8 is substantially the same as the coring assembly of FIGS. 3A-6 above, except as described below. For example, the coring assembly 850 of FIG. 8 can have at least one wall 831 that forms a cavity 837. Also, there can be one or more channels 833 in the outer surface of the wall 831 having one or more sealing members 832 disposed therein. Further, there are two flow regulation devices in the cavity 837 of the coring assembly 850, where flow regulation device 835 is a float valve, as is the flow regulation device 335 of FIGS. 3A-6. In addition, there is a stroke restrictor 891 disposed within the cavity 837 between two flow regulating devices (flow regulating device 835 and flow regulating device 845 in this case).

Further, the flow regulation device 835 of FIG. 8 includes a conically shaped plunger valve 341 around the base of which is disposed a sealing member 332 (e.g., a gasket, an O-ring), a base 343, and a variable length extension 344 disposed between the base 343 and the plunger valve 341. The flow regulating device 335 of FIG. 8 also includes a resilient device 342 wrapped around the extension 344 and disposed between the base 343 and the plunger valve 341. The position of the flow regulation device 835 within the cavity 837 can be defined by a distance 849 between the stroke restrictor 887 and the base of the plunger valve 341.

The configuration of the flow regulation device 845 of FIG. 8 differs from the configuration of the flow regulation device 345 of FIGS. 3A-6. Rather than a float valve, the flow regulation device 845 of FIG. 8 is configured with a flat plate 841 with an extension 889 that extends outward from its center. The flat plate 841 is coupled to an extension 844, which is coupled to a base 843. The extension 844 is configured to extend outward and retract inward relative to the base 843, moving the plate 841 closer to and further away from the stroke restrictor 838.

As the plate 841 is pushed downward and approaches the stroke restrictor 838, the extension 844 of the flow regulation device 845 is inserted into the aperture 888 in the stroke restrictor 838. Eventually, when the mode of operation is a coring operation, the plate 841 of the flow regulation device 845 makes direct contact with the stroke restrictor 838, preventing fluid from flowing therethrough. The position of the flow regulation device 845 within the cavity 837 can be defined by a distance 839 between the stroke restrictor 838 and the plate 841.

Figure 9:
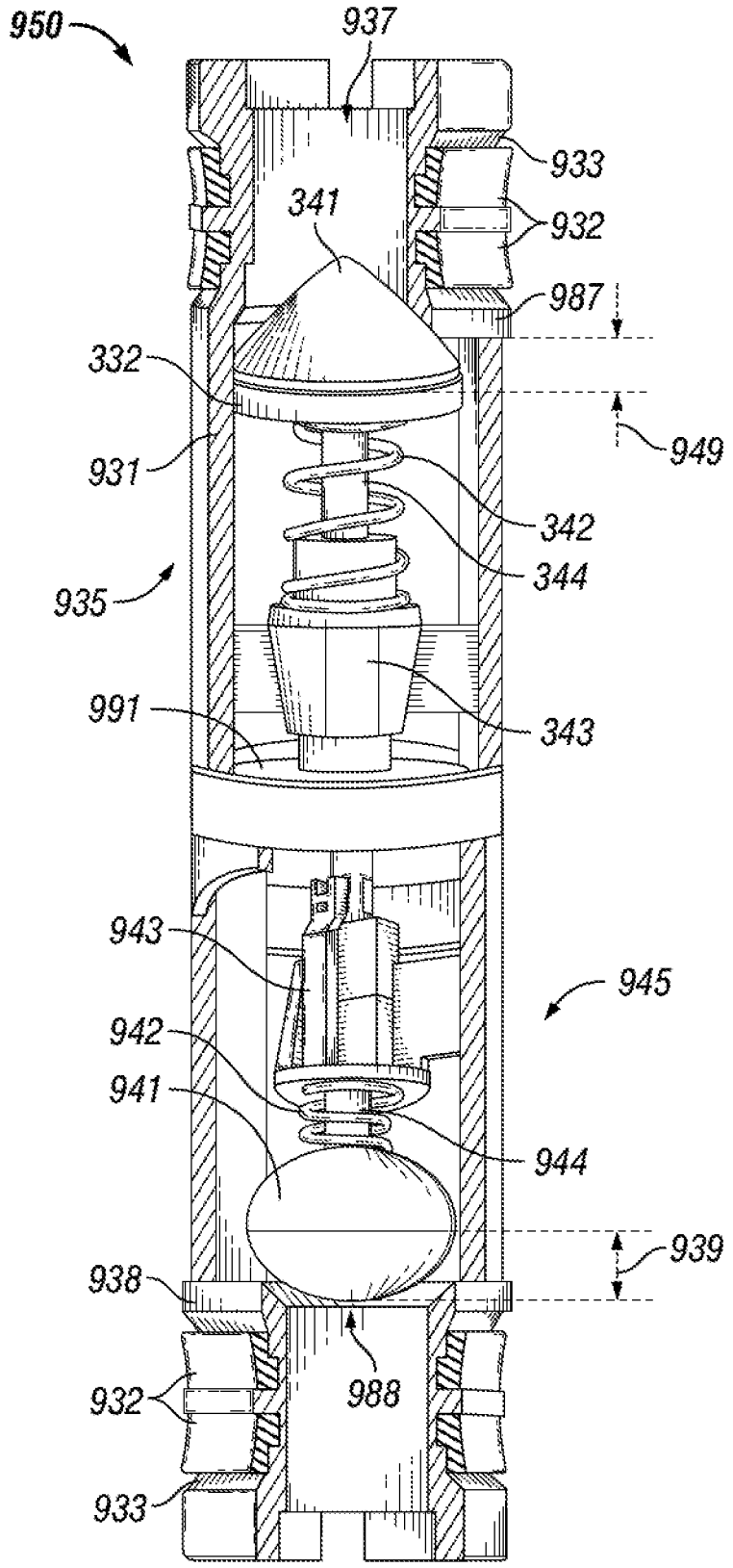
FIG. 9 shows yet another subterranean coring assembly configured in a default position in accordance with certain example embodiments.

FIG. 9 shows yet another subterranean coring assembly 950 configured in a default position in accordance with certain example embodiments. Referring to FIGS. 1-9, the coring assembly 950 of FIG. 9 is substantially the same as the coring assemblies described above, except as described below. For example, the coring assembly 950 of FIG. 9 can have at least one wall 931 that forms a cavity 937. Also, there can be one or more channels 933 in the outer surface of the wall 931 having one or more sealing members 932 disposed therein. Further, there are two flow regulation devices in the cavity 937 of the coring assembly 950, where flow regulation device 935 is a float valve, similar to the flow regulation device 335 of FIGS. 3A-6 and the flow regulation device 835 of FIG. 8. In addition, there is a stroke restrictor 991 disposed within the cavity 937 between two flow regulating devices (flow regulating device 935 and flow regulating device 945 in this case).

Further, the flow regulation device 935 of FIG. 9 includes a conically shaped plunger valve 341 around the base of which is disposed a sealing member 332 (e.g., a gasket, an o-ring), a base 343, and a variable length extension 344 disposed between the base 343 and the plunger valve 341. The flow regulating device 335 of FIG. 9 also includes a resilient device 342 wrapped around the extension 344 and disposed between the base 343 and the plunger valve 341. The position of the flow regulation device 935 within the cavity 937 can be defined by a distance 949 between the stroke restrictor 987 and the base of the plunger valve 341.

The configuration of the flow regulation device 945 of FIG. 9 differs from the configuration of the flow regulation device 345 of FIGS. 3A-6 and the flow regulation device 845 of FIG. 8. Rather than a float valve or a plate with an outward extension, the flow regulation device 945 of FIG. 9 is configured with a sphere 941. The sphere 941 is coupled to an extension 944, which is coupled to a base 942. The extension 944 is configured to extend outward and retract inward relative to the base 942, moving the sphere 941 closer to and further away from the stroke restrictor 938.

As the sphere 941 is pushed downward and approaches the stroke restrictor 938, the distal part of the sphere 941 of the flow regulation device 945 is inserted into the aperture 988 in the stroke restrictor 938. Eventually, when the mode of operation is a coring operation, the sphere 941 of the flow regulation device 945 makes direct contact with the stroke restrictor 938, preventing fluid from flowing therethrough. The position of the flow regulation device 945 within the cavity 937 can be defined by a distance 939 between the stroke restrictor 938 and the center of the sphere 941.

Figure 10A:
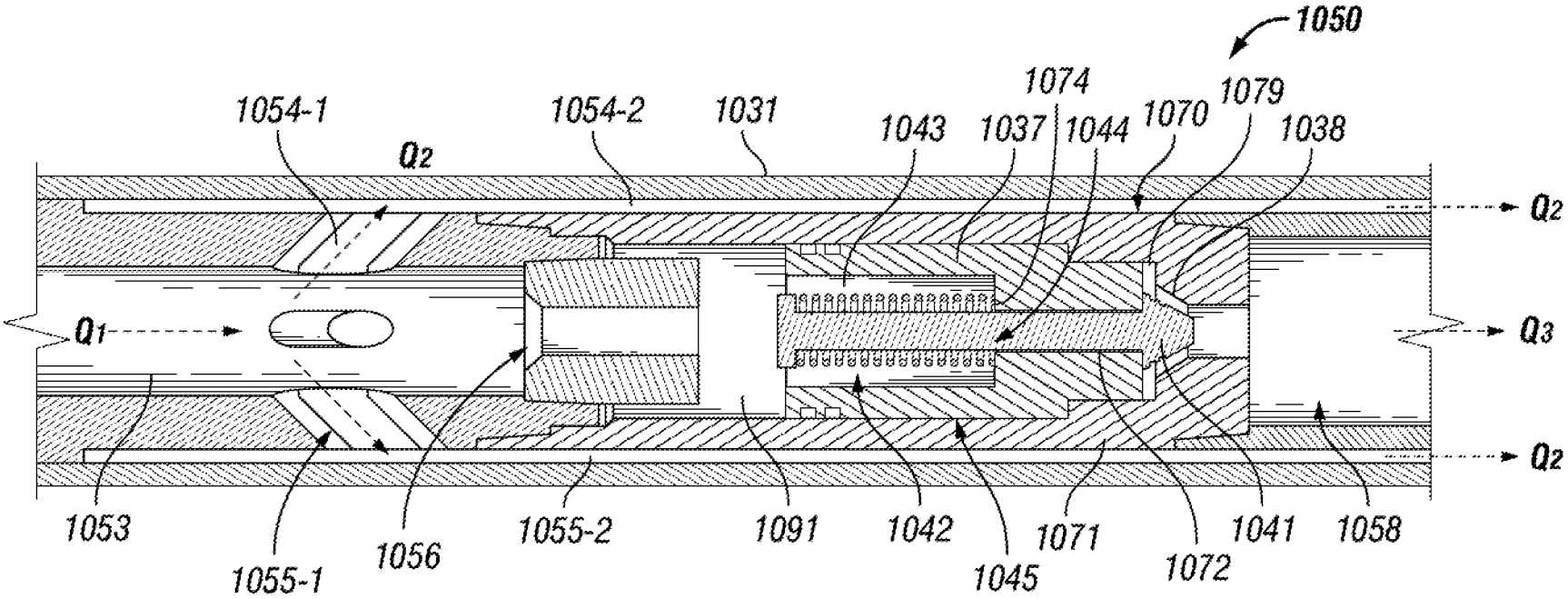
FIGS. 10A and 10B show still another subterranean coring assembly in an open position in accordance with certain example embodiments.
Figure 10B:
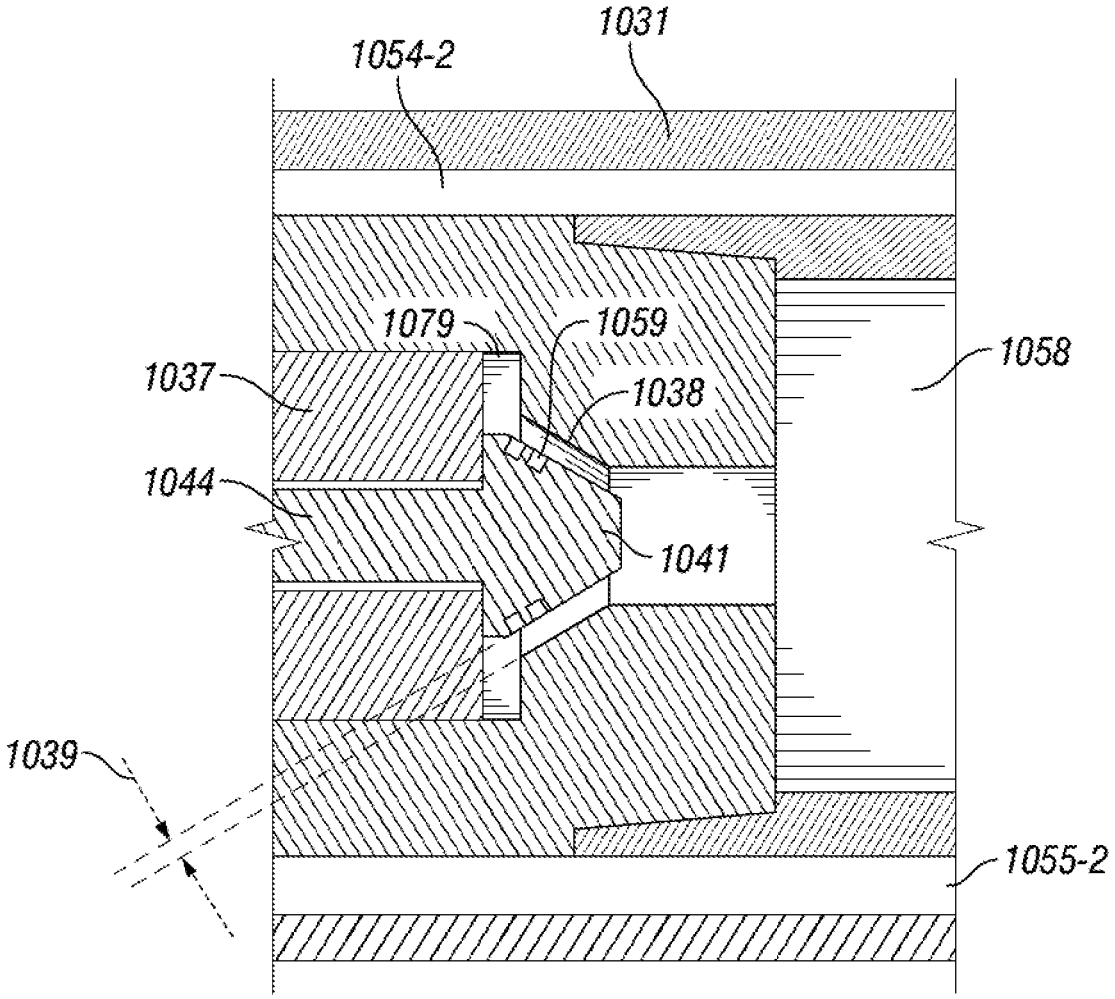
Figure 11B:
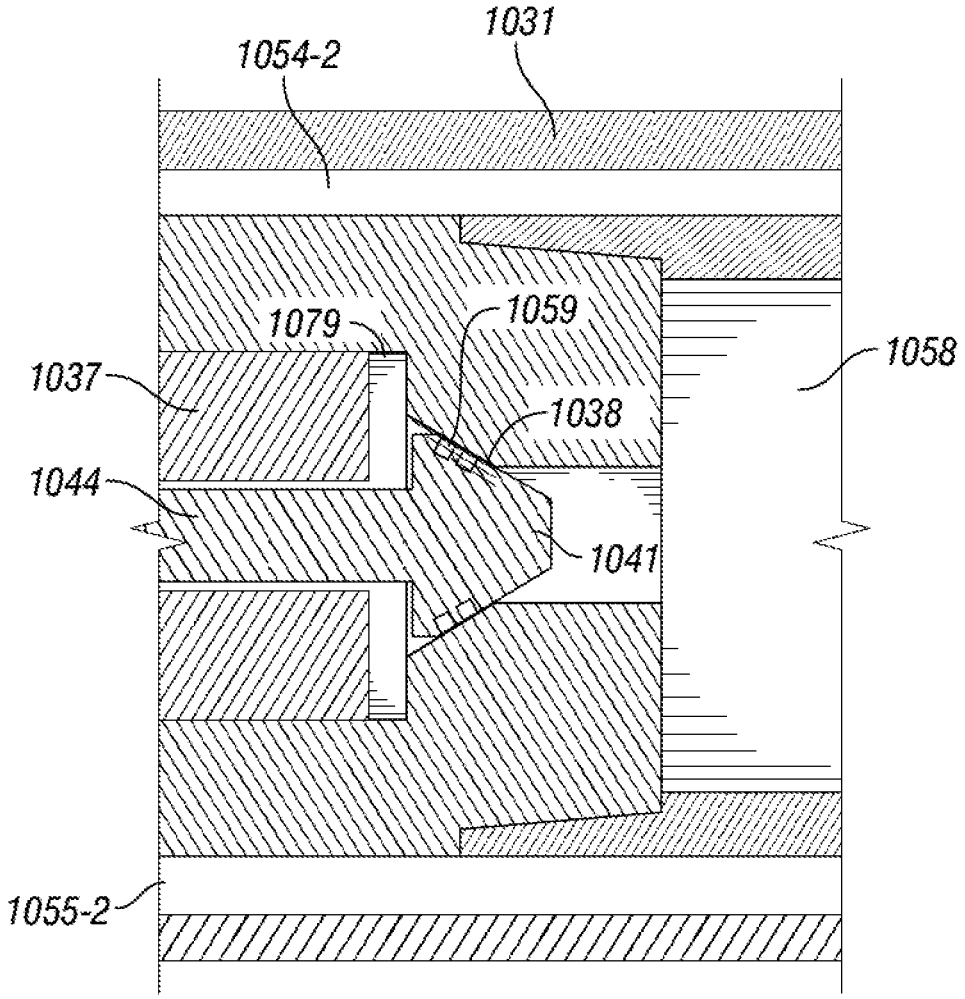
Figure 12B:
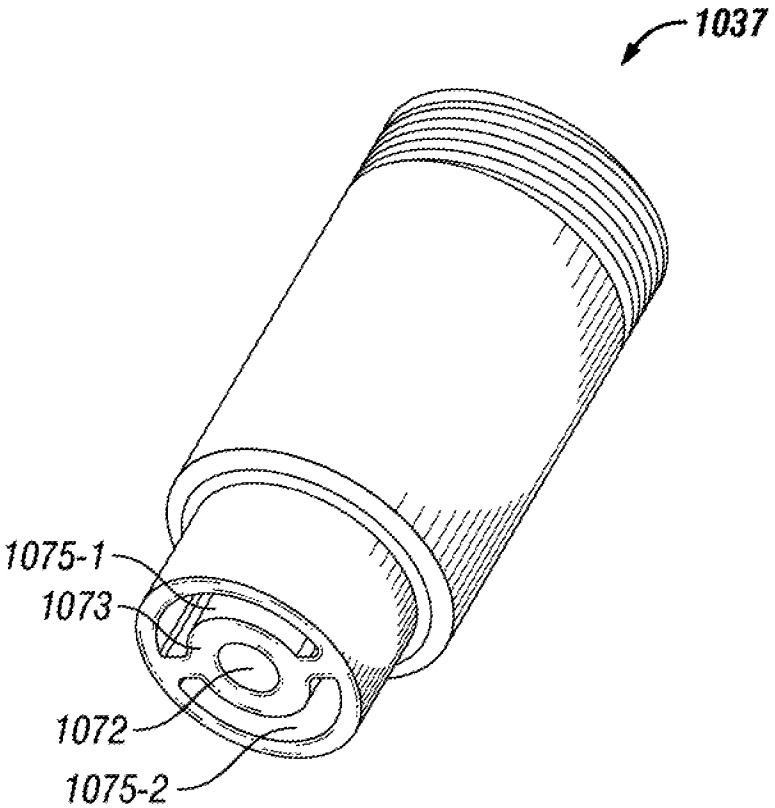
FIGS. 12A and 12B show the inner housing of the flow regulating device of FIGS. 10A through 11B.
Figure 12A:
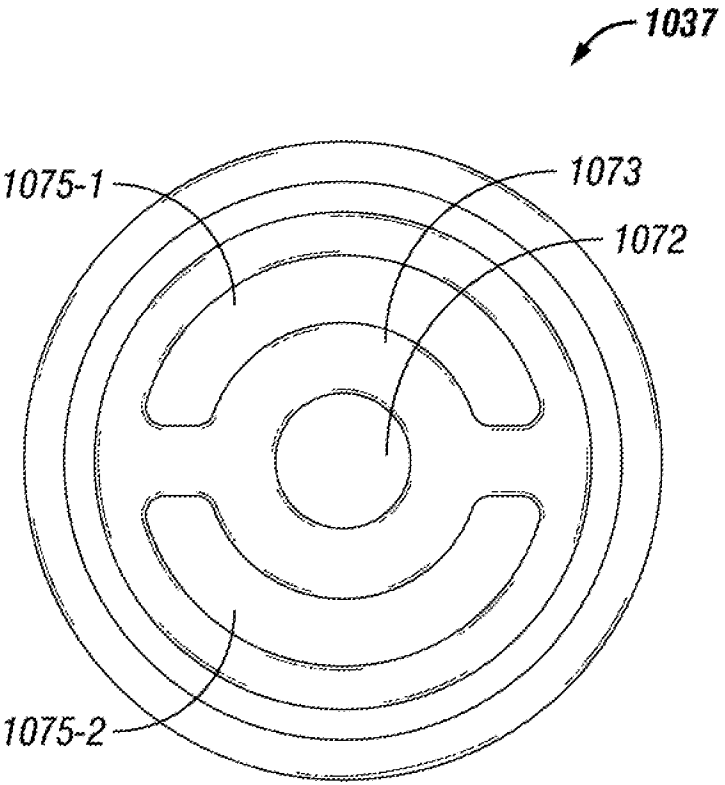

FIGS. 10A and 10B show still another subterranean coring assembly 1050 in an open position in accordance with certain example embodiments. Specifically, FIG. 10A shows the subterranean coring assembly 1050 in an open position, and FIG. 10B shows a detailed view of the plunger valve 1041 of the subterranean coring assembly 1050 of FIG. 10A. Also, FIGS. 11A and 11B show the subterranean coring assembly of FIGS. 10A and 10B in a closed position in accordance with certain example embodiments. Specifically, FIG. 11A shows the subterranean coring assembly 1050 in a closed position, and FIG. 11B shows a detailed view of the plunger valve 1041 of the subterranean coring assembly 1050 of FIG. 11A. FIGS. 12A and 12B show a front view and front-side perspective view, respectively, of the inner housing 1037 of the flow regulating device 1045 of FIGS. 10A through 11B.

In this example, the subterranean coring assembly 1050 of FIGS. 10A and 10B includes a flow regulating subassembly 1070. The flow regulating assembly 1070 is an integrated combination of an outer housing 1071 inside of which is disposed a flow regulating device 1045. In this case, the flow regulating device 1045 includes an inner housing 1037 that forms an extension channel 1072 and a cavity 1043 along its axial length, an extension 1044 movably disposed within the extension channel 1072 and the cavity 1043, a resilient device 1042 disposed around the extension 1044 within the cavity 1043, and a plunger valve 1041 disposed at a distal end of the extension 1044.

At the proximal end of the extension 1044 is an entry cavity 1091 to help facilitate fluid flow through the flow regulating device 1045 when the flow regulating device 1045 is in an open position. The resilient device 1042 can be substantially similar to the resilient devices discussed above.

For example, the resilient device 1042 of FIGS. 10A and 11A can be a resilient, compliant, preloaded spring.

The inner housing 1037 of the flow regulating device 1045, as detailed in FIGS. 12A and 12B, show the extension channel 1072 inside of which the extension 1044 is disposed. There is also a distal housing surface 1073 against which the plunger valve 1041 abuts when the plunger valve 1041 is in the fully open position. In this way, the distal surface 1073 acts as a stop for the plunger valve 1041. The distal housing surface 1073 is designed to form a gap 1079 with the outer housing 1071 proximate to where the stroke restrictor 1038 (discussed below) is located.

In addition, the inner housing 1037 can include one or more flow channels 1075 that extend through some or all of the length of the inner housing 1037. For example, in this case, there are two flow channels 1075 (flow channel 1075-1 and flow channel 1075-2). Each of the two flow channels 1075 forms a near semi-circular arc segment, centered around the extension channel 1072, that extends between the distal housing surface 1073 and a distal cavity surface 1074, which defines the distal end of the cavity 1043 within the inner housing 1037. The shape, size, and/or other characteristics of the flow channels 1075 can vary compared to what is shown in FIGS. 12A and 12B. Fluid that flows through the flow channels 1075 enters into the gap 1079, regardless of the position of the plunger valve 1041 relative to the stroke restrictor 1038. The flow channels 1075 are not shown in FIGS. 10A through 11B.

Referring to FIGS. 1 through 12B, the subterranean coring assembly 1050 of FIGS. 10A and 10B is substantially the same as the subterranean coring assemblies discussed above, except as described below. For example, the subterranean coring assembly 1050 of FIGS. 10A and 10B can include at least one wall 1031, inside of which the flow regulating subassembly 1070 is disposed. The outer perimeter of the outer housing 1071 of the flow regulating subassembly 1070 is less than the inner perimeter of the wall 1031, creating one or more channels (e.g., channel 1054-2, channel 1055-2) therebetween for fluid to flow. In this case, there is only one flow regulation device 1045 in the flow regulating subassembly 1070 of the coring assembly 1050, where the flow regulation device 1045 is a diversion valve, as discussed above.

The characteristics (e.g., shape, size) of the plunger valve 1041 of the flow regulation device 1045 of FIGS. 10A and 10B can be designed to complement the corresponding characteristics of the stroke restrictor 1038 (also called a sealing surface 1038) of the outer housing 1071. For example, in this case, the plunger valve 1041 is conically shaped to match the conical shape of the stroke restrictor 1038. In this way, when the flow regulation device 1045 is moved to the closed position, as shown in FIGS. 11A and 11B below, the plunger valve 1041 abuts against the stroke restrictor 1038.

In some cases, as shown in FIGS. 10A and 10B, there are one or more channels 1059 (e.g., cylindrical grooves) disposed in the outer surface of the plunger valve 1041. In such a case, one more sealing members (e.g., gasket, o-ring) can be disposed in the channels 1059 to create a seal with the stroke restrictor 1038 when the flow regulation device 1045 is in the closed position.

The position of the flow regulation device 1045 relative to the stroke restrictor 1038 defines a flow area for the fluid and can be defined by a distance 1039 between the stroke restrictor 1038 and the outer surface of the plunger valve 1041. Since the distance 1039 (flow area) in FIGS. 10A and 10B is not zero or substantially not zero, the flow regulation device 1045 is in an open position. This allows some of the fluid (Q3 in FIG. 10A) to flow through the flow channels 1075 in the inner housing 1037, into the gap 1079 between the inner housing 1037 and the outer housing 1071, past the gap (defined by distance 1039) between the plunger valve 1041 and the stroke restrictor 1038, and into the core chamber 1058. Q1 in FIG. 10A represents all of the fluid before it reaches the flow regulation device 1045.

The distance 1039 (and so the flow area) can be varied or adjusted by one or more of any of a number of factors, including but not limited to the characteristics of the resilient device 1042, the shape and size of the plunger valve 1041, the nominal size of the gap 1079, and the flow rate of the fluid. As the distance 1039 can vary, there can be a number of discrete or continuous open positions of the flow regulation device 1045. The degree to which the flow regulation device 1045 is open (the magnitude of the distance 1039) can be controlled by the flow rate of the fluid (e.g., Q1, Q4), and this can depend on the operation (e.g., run-in-hole operation, flushing operation, coring operation, tripping operation) being performed at a particular point in time.

At the ball seat 1056 (which does not have a ball and which is located just upstream of the flow regulation device 1045), the majority of the fluid, represented by Q2 in FIG. 10A, flows through plug port 1054-1 (also called diversion port 1054-1) and channel 1054-2 (also called an annular passage 1054-2), which is disposed between the wall 1031 of the subterranean coring assembly 1050 and the outer housing 1071 of the flow regulating subassembly 1070, and plug port 1055-1 (also called diversion port 1055-1) and channel 1055-2 (also called an annular passage 1055-2), which is disposed between the wall 1031 of the subterranean coring assembly 1050 and the outer housing 1071 of the flow regulating subassembly 1070.

The plunger valve 1041 is kept separated from the stroke restrictor 1038, thereby keeping the flow regulation device 1045 in an open position, by the stiffness of the resilient device 1042, which counteracts the momentum of the flow-rate of the fluid Q1 flowing through the flow regulating subassembly 1070. When the coring process is ready to begin, the flow of the fluid Q3 through the cavity 1043, through the flow channels 1075 of the inner housing 1037, into the gap 1079 between the inner housing 1037 and the outer housing 1071, past the gap (defined by distance 1039) between the plunger valve 1041 and the stroke restrictor 1038, and into the core chamber 1058 must be stopped so that the core chamber 1058 can receive a core sample. The flow regulation device 1045 can be moved from an open position to the closed position (thereby actuating the plunger valve 1041 and causing the plunger valve 1041 to abut against the stroke restrictor 1038) by changing (in this case, increasing) the rate of flow of the downhole fluid from Q1 in FIG. 10A to Q4 in FIG. 11A.

When this occurs, the entire flow of the fluid Q4 is diverted through the diversion ports 1054 and subsequently the annular passages 1055 so that the fluid exits through the coring bit to facilitate the coring process. The flow regulation device 1045 remains in the closed position for the amount of time that the flow rate of the fluid Q4 exceeds the threshold value to overcome the force applied by the resilient device 1042 of the flow regulation device 1045.

Once the coring process is complete, the flowrate of the fluid is decreased, which causes the flow regulation device 1045 to return to an open position (e.g., a normally-open or fully-open position). This allows expansion of entrained gasses to escape the core chamber 1058 as the pressure is decreased as the subterranean coring assembly 1050 is brought to surface. Example embodiments can be used with any of a number of new and/or existing equipment. For example, as shown in FIGS. 10A through 11B, the subterranean coring assembly 1050 includes an existing ball seat 1056 for an existing "drop ball" configuration.

The systems, methods, and apparatuses described herein allow for subterranean coring assemblies. Example embodiments can control the flow of fluid for various modes of operation related to and including coring without the use of a diversion ball or other device that must be introduced at the surface prior to commencement of such modes of operation. Instead, changing the flow rate of the fluid flowing through the BHA can be used to change the configuration of the example coring assembly for every mode of operation involved in the coring process. As a result, example embodiments save time, ensure more reliable and controlled transition between modes of operation related to coring, and use fewer resources compared to embodiments currently used in the art.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A subterranean coring assembly, comprising:

an outer wall;

an inner housing disposed within the outer wall, the inner housing comprising at least one first wall that forms a first cavity and at least one flow channel that traverses a length of the inner housing, wherein the at least one flow channel has a top end and a bottom end;

at least two annular passages disposed between the outer wall and the inner housing and bypassing the inner housing; and a flow regulating device comprising a first portion and a second portion coupled to the first portion, wherein the first portion is movably disposed within the first cavity of the inner housing, wherein the second portion is disposed adjacent to the bottom end of the at least one flow channel of the inner housing, wherein the flow regulating device is configured to move from a first operating position to a second operating position based on first flow characteristics of fluid that flows into the top end of the at least one flow channel toward the bottom end of the at least one flow channel and toward the second portion of the flow regulating device adjacent to the bottom end of the at least one flow channel, and wherein in the second operating position the second portion restricts flow of the fluid through the flow regulating device and forces the fluid to flow through the at least two annular passages thereby bypassing the inner housing.

2. The subterranean coring assembly of claim 1, wherein the first operating position of the flow regulating device allows the fluid to flow around the second portion of the flow regulating device.

3. The subterranean coring assembly of claim 1, wherein the first operating position corresponds to a flushing mode of operation, and wherein the second operating position corresponds to a coring mode of operation, wherein the flow regulating device is closed in the second position.

4. The subterranean coring assembly of claim 1, further comprising:

a resilient device disposed around the first portion of the flow regulating device within the first cavity of the inner housing.

5. The subterranean coring assembly of claim 4, wherein the resilient device comprises a compression spring.

6. The subterranean coring assembly of claim 4, wherein the resilient device returns the flow regulating device to a default position when the flow characteristics of the fluid fall below a threshold level.

7. The subterranean coring assembly of claim 4, wherein the first cavity is free of the fluid when the first portion of the flow regulating device moves within the first cavity.

8. The subterranean coring assembly of claim 1, wherein the at least one flow channel comprises a plurality of flow channels, wherein the plurality of flow channels are symmetrically distributed about an axis along the length of the inner housing.

9. The subterranean coring assembly of claim 1, wherein the second portion of the flow regulating device comprises a plunger valve.

10. The subterranean coring assembly of claim 9, wherein an outer surface of the plunger valve comprises at least one groove inside of which is disposed at least one sealing member.

11. The subterranean coring assembly of claim 1, further comprising:

an outer housing disposed within the outer wall, the outer housing comprising at least one second wall the forms a second cavity, wherein the inner housing is disposed within the second cavity of the outer housing.

12. The subterranean coring assembly of claim 11, wherein the at least one second wall forms a stroke restrictor toward a distal end of the outer housing, wherein the second portion of the flow regulating device abuts against the stroke restrictor when the flow regulating device is in a fully closed position.

13. The subterranean coring assembly of claim 11, wherein the inner housing has a protrusion that extends from an outer surface of the at least one first wall that complements a seat formed on an inner surface of the at least one second wall of the outer housing.

14. A coring bottom hole assembly (BHA) comprising:

an upstream section comprising a first coupling feature disposed on a distal end thereof;

a downstream section comprising a catcher assembly, a core head, and a second coupling feature disposed on a proximal end thereof; and a subterranean coring assembly coupled to and disposed between the upstream portion and the downstream portion, wherein the subterranean coring assembly comprises:

an upstream section coupling feature that couples to the first coupling feature of the upstream section;

a downstream section coupling feature that couples to the second coupling feature of the downstream section;

an outer wall;

an inner housing disposed within the outer wall, the inner housing comprising at least one first wall that forms a first cavity and at least one flow channel, wherein the first cavity is physically isolated from the at least one flow channel, wherein the at least one flow channel is configured to receive a fluid for flow therethrough, wherein the first cavity is configured to prevent the fluid from flowing therethrough;

at least two annular passages disposed between the outer wall and the inner housing and bypassing the inner housing; and a flow regulating device partially disposed within the first cavity, wherein the flow regulating device is configured to move from a first operating position to a second operating position within the first cavity based on flow characteristics of the fluid that flows through the at least one flow channel toward the downstream section, wherein in the second operating position the flow regulating device restricts flow of the fluid through the flow regulating device and forces the fluid to flow through the at least two annular passages thereby bypassing the inner housing.

15. The coring BHA of claim 14, wherein the subterranean coring assembly further comprises:

an outer housing disposed within the outer wall, the outer housing comprising at least one second wall the forms a second cavity, wherein the inner housing is disposed within the second cavity of the outer housing.

16. The coring BHA of claim 14, wherein the subterranean coring assembly further comprises:

a resilient member disposed around a portion of the flow regulating device within the first cavity.

17. A method for performing a subterranean coring operation in a wellbore, the method comprising:

receiving fluid from an upstream section of a coring bottom hole assembly (BHA), wherein the fluid has a first flow rate through at least one flow channel of an inner housing of a subterranean coring assembly; and moving, based on the first flow rate of the fluid, a first flow regulating device within a cavity of the inner housing of the subterranean coring assembly, wherein the first flow regulating device moves to a first operating position within the cavity of the inner housing when the first flow rate of the fluid through the at least one flow channel of the inner housing is within a first range of flow rates, wherein the first flow regulating device moves to a second operating position within the cavity of the inner housing when the fluid has a second flow rate through the at least one flow channel of the inner housing, wherein the second flow rate is within a second range of flow rates, wherein the first operating position corresponds to a flushing mode of operation, wherein the second operating position corresponds to a coring mode of operation and is achieved by forcing a distal end of the flow regulating device to abut against a stroke restrictor, forcing the fluid to flow in at least two annular passages disposed between an outer wall and the inner housing, thereby bypassing the inner housing, wherein the second flow rate exceeds the first flow rate.

18. The method of claim 17, further comprising:

returning, when the second flow rate of the fluid is decreased below a threshold value, the first flow regulating device to a default position, wherein the default position corresponds to a tripping mode of operation.

* * * * *